US006089972A

United States Patent [19]

Gunji et al.

[11] Patent Number: 6,089,972

[45] Date of Patent: Jul. 18, 2000

[54] AIR CONDITIONER

[75] Inventors: Yoshihiro Gunji; Masataka Nakamura, both of Kanagawa-ken, Japan

[73] Assignee: Fujitsu General Limited, Kawasaki, Japan

[21] Appl. No.: 09/255,740

[22] Filed: Feb. 23, 1999

[30] Foreign Application Priority Data

Apr. 17, 1998 [JP] Japan ..... 10-108162

[51] Int. Cl.[7] ..... F24F 1/00

[52] U.S. Cl. ..... 454/233; 454/313; 62/407

[58] Field of Search ..... 62/407, 411, 419, 62/DIG. 16, 404; 454/313, 233, 321

[56] References Cited

FOREIGN PATENT DOCUMENTS

| | | |
|---|---|---|
| 404006343 | 1/1992 | Japan . |
| 406341702 | 12/1994 | Japan . |
| 411094347 | 4/1999 | Japan . |

*Primary Examiner*—Henry Bennett
*Assistant Examiner*—Chen-Wen Jiang
*Attorney, Agent, or Firm*—Kaensaka & Takeuchi

[57] ABSTRACT

In a ceiling-mounted-in type of air conditioner, the assembling operability is improved with the number of parts of a wind directing plate driving portion being reduced. A motor and a cam gear can be previously assembled and attached in a motor cover in order to reduce the thickness of a front panel, thereby allowing easy placement of a wind directing plate driving device on a front panel 3 only by mounting the motor cover on the front panel.

20 Claims, 23 Drawing Sheets

FIG. 25 Prior Art
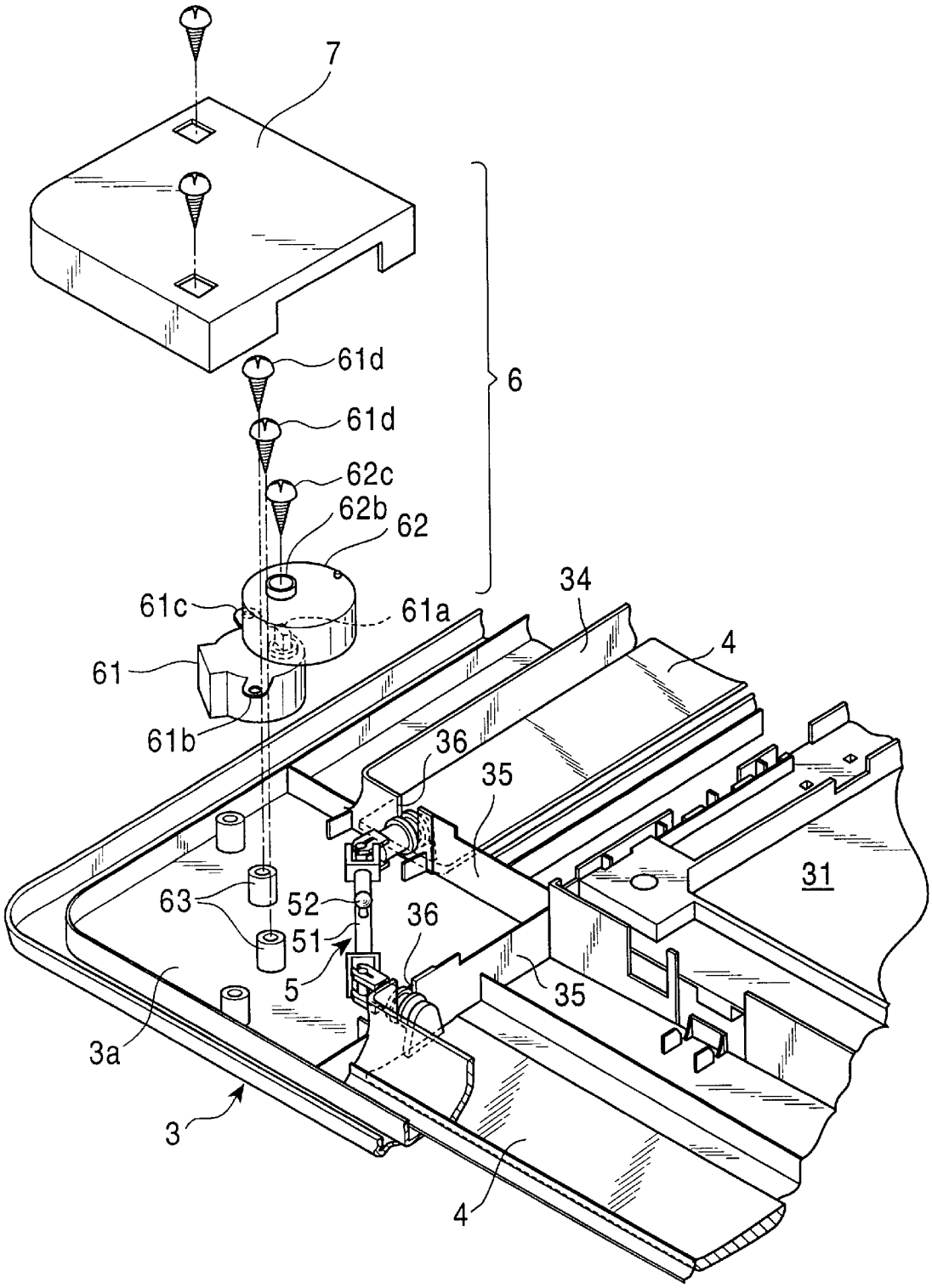

FIG. 26 Prior Art
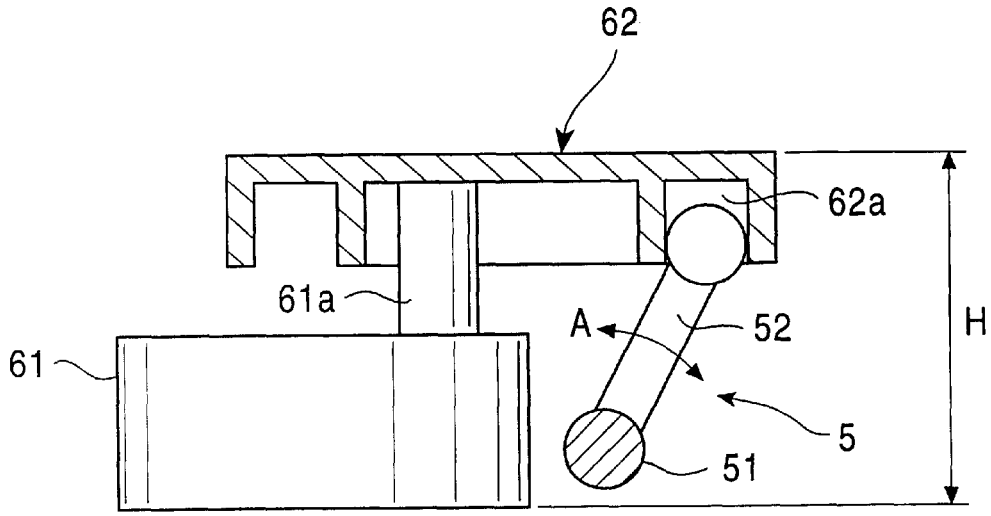
FIG. 27 Prior Art
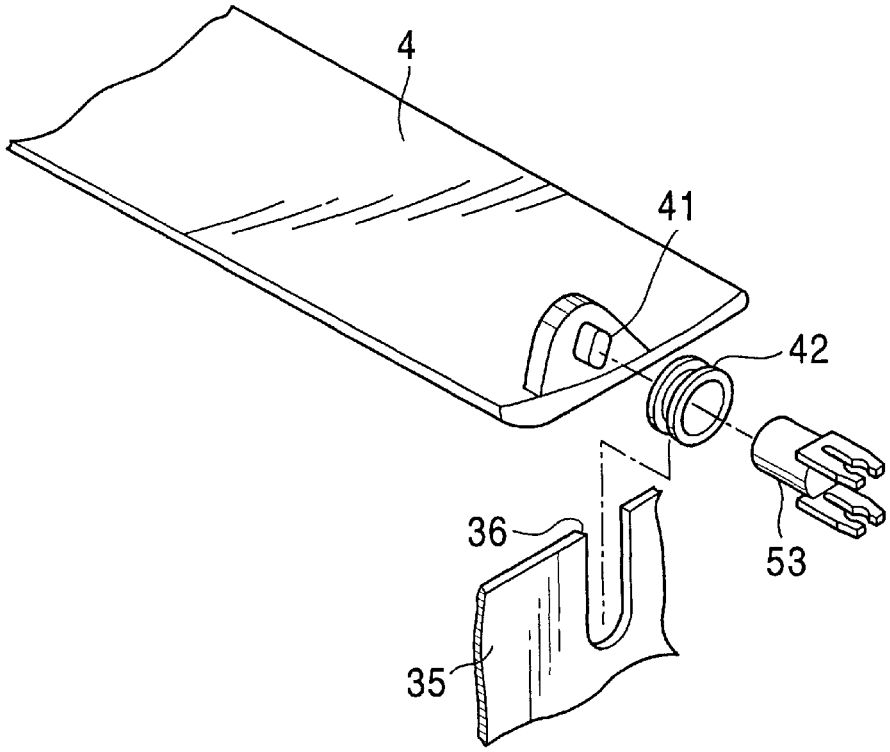

AIR CONDITIONER

BACKGROUND OF THE INVENTION

1. Field of the Invention

The present invention relates to a ceiling-mounted-in type of air conditioner, and more particularly, to an air conditioner with fewer parts in a wind directing plate driving portion, with excellent assembling operability, and with slimmer front panel.

2. Description of the Related Art

First, with reference to FIG. 23, the general configuration of the conventional ceiling-mounted-in type of air conditioner will be explained, and then disadvantages of the air conditioner will be described. An air conditioner 1 includes a main body housing 2 embedded in a ceiling with the bottom face at the indoor side being opened, and a front panel 3 attached to the bottom face side of the main body housing 2 so as to be attachable and detachable.

A bell-mouth 21 is provided almost at the center of the bottom side of the main body housing 2, and a first opening 22 for an air inlet is formed by the bell-mouth 21. A second opening 23 for an air inlet is formed around the first opening 22, that is, around the bottom face of the main body housing 2.

A turbo fan 24 serving as an air blowing means for taking in indoor air from the first opening 22 and for blowing the air towards the second opening 23 is provided in the main body housing 2. A heat exchanger 25 is provided in an air passage continuing from the turbo fan 24 to the second opening 23 in such a way as to surround the turbo fan 24. A drain pan 26 is disposed under the heat exchanger 25.

An air inlet 31 communicated with the first opening 22 of the main body housing 2 is provided in the middle of the front panel 3. An anti-dust filter 32 and a decorative grill 33 are mounted in the air inlet 31 to be attachable and detachable. Four of air outlets 34 disposed to be communicated with the second opening 23 are formed along each side of the main body housing 2 around the front panel 3. Incidentally only two of the air outlets 34 opposing to each other are shown in FIG. 23 for convenience in creating the drawing.

Each of the air outlets 34 is provided with a wind directing plate 4 in a band plate shape therein as illustrated in FIG. 24. Each of the wind directing plates 4 is vertically rotatable around a horizontal axis of rotation, and the wind directing plates 4 adjacent to each other are coupled by a hook type of universal joint 5 so as to be rotatable synchronously with each other.

Referring to FIG. 25 in addition, wind directing plates driving means 6 is provided at a specified corner portion 3*a* of the front panel 3. The wind directing plates driving means 6 includes a motor 61 and a cylindrical cam 62. The motor 61 includes mounting flanges 61*b* and 61*c* on both sides thereof, and is fixed on bosses 63 and 63 vertically provided on the corner portion 3*a* by the medium of the mounting flanges 61*b* and 61*c* with mounting screws 61*d* and 61*d*.

A cam slot 62*a* is formed in a circular form at the bottom face side of the cam 62 as is illustrated in FIG. 26. A lever 52 engaged in the cam slot 62*a* of the cam 62 is provided at a main shaft 51 side of the universal joint 5.

The cam 62 has a mounting hole 62*b* for the motor 61 at the position displaced from the center thereof, and is mounted onto an output shaft 61*a* of the motor 61 with the mounting screw 62*c* inserted through the mounting hole 62*b* while checking the alignment of the lever 52 and the cam slot 62*a* so that the lever 52 of the universal joint 5 is engaged in the cam slot 62*a*.

A rib plate 35 forming a part of the air outlet 34 is vertically provided at each of the corner portions of the front panel 3, and an almost U-shaped bearing slot 36 for rotatably supporting the wind directing plate 4 is formed on the rib plate 35.

On supporting the wind directing plate 4 in the bearing slot 36, in the prior art, as illustrated in FIG. 27, a joint member 53 of the hook-type of universal joint 5 is attached to a rotational shaft 41 of the wind directing plate 4 after a sleeve bush 42 as a separate part is fitted onto the shaft portion of the joint member 53. After the sleeve bush 42 is slipped into the bearing slot 36, a holding piece, not illustrated, for preventing the disengagement is attached thereon in the bearing slot 36.

A motor cover 7 is finally placed so as to cover the entire body of the wind directing plates driving means 6. When the motor 61 reciprocatingly rotates the cam 62 at a predetermined angle, the rotational movement is converted into linear movement by the cam slot 62*a* and the lever 52. Thereby the hook type of universal joint 5 is reciprocatingly rotated in a direction shown by arrows A in FIG. 26, and with this, each of the wind directing plates 4 is synchronously rotated around the rotational shaft 41 in a vertical direction.

The above-described conventional embodiment has disadvantages as described below. First, there is a disadvantage in the operability, since the motor 61, the cam 62, and the like are attached in the corner portion 3*a* of the front panel 3 having only a limited space.

As is shown in FIG. 26, the cam 62 is laid on the motor 61, therefore a height H of the wind plates driving portion 6 becomes higher by the thickness of the cam 62, which doesn't allow the front panel 3 to have a slimmer body.

The helical cam slot 62*a* on the back side of the cam 62 cannot be seen from the position above the cam 62, therefore aligning the cam slot 62*a* with the lever 52 is difficult in attaching the cam 62 on the motor 61, which makes the assembling operation more difficult.

Since separate parts such as the sleeve bush 42 and the holding piece for preventing the disengagement are needed to support the wind directing plate 4 in the bearing slot 36 in addition to many points to be screwed, the number of parts are larger as a whole, therefore it not only costs more but also takes some efforts in the maintenance of the parts.

SUMMARY OF THE INVENTION

The present invention is made to eliminate the aforementioned various disadvantages, and its object is to provide an air conditioner which is excellent in operability with the smaller number of parts especially in a wind directing plate driving portion, and with a front panel formed to be slimmer.

In order to attain the aforementioned object, the present invention is an air conditioner which includes an almost rectangular, main body housing provided with a first opening for taking in air at the middle portion of the bottom face and with a second opening for blowing air being formed around the aforementioned first opening, and placed to be embedded in an indoor ceiling, and a front panel attached on the bottom face of the aforementioned main body housing to be attachable and detachable, with the aforementioned main body housing being provided inside with an air fan for taking in indoor air from the aforementioned first opening and for blowing the air towards the aforementioned second opening, and a heat exchanger disposed around the aforementioned air fan, and with the aforementioned front panel being provided with an air inlet communicated with the aforementioned first opening, four of air outlets disposed along the respective sides of the aforementioned main body housing to be communicated with the aforementioned second opening, a wind directing plate vertically rotating around a horizontal axis of rotation in each of the aforementioned air outlets, a coupling means for coupling each of the aforementioned wind directing plates to be synchronously rotated, and a wind directing plate driving means for driving the aforementioned wind directing plates, and with only one aforementioned wind directing plate driving means being formed to drive the aforementioned wind directing plates. The aforementioned wind directing plate driving means includes a motor having an output gear, a cam gear having a gear portion meshed with the aforementioned output gear on the periphery thereof with a helical cam slot being formed on one of the faces, a lever which is provided at the aforementioned coupling means, and which converts the rotational motion of the aforementioned cam slot into linear motion and transmits the motion to the aforementioned coupling means, and a motor cover mounted on a predetermined corner portion of the aforementioned front panel, with the aforementioned motor and the aforementioned cam gear being assembled and attached on the inside surface, which faces the aforementioned front panel, of the aforementioned motor cover.

According to the aforementioned configuration, the motor and the cam gear have been previously assembled and attached on the motor cover, therefore the wind directing plate driving means can be easily mounted on the front panel only by mounting the motor cover on the front panel.

In the present invention is also characterized by the aforementioned motor cover is provided with a motor mounting pedestal having a shaft insertion hole, and a cam gear housing recess having a cut-out portion at the part thereof facing the aforementioned motor mounting pedestal with a rotational shaft of the aforementioned cam gear being vertically provided at the center thereof, with the aforementioned motor is mounted on the inside surface of the aforementioned motor mounting pedestal with the output shaft thereof being inserted through the aforementioned shaft insertion hole, and the aforementioned output gear is mounted onto the output shaft of the aforementioned motor on the outside surface of the aforementioned motor mounting pedestal and is meshed with the aforementioned cam gear, which is in the aforementioned cam gear housing recess, in the aforementioned cut-out portion.

It is preferable that the aforementioned shaft insertion hole is an oblong along a radial direction of the aforementioned cam gear housing recess, thereby enabling to arbitrarily adjust the distance between the aforementioned output gear and the aforementioned cam gear.

In the present invention, the aforementioned motor includes mounting flanges on both sides thereof, and a hook for engaging one of the mounting flanges and a screw bearing boss for fastening the other of the mounting flanges with a screw are provided on the inside surface of the aforementioned motor mounting pedestal, thereby enabling to fix the motor with only one mounting screw.

One of the characteristics of the present invention is that an inverted L-shaped fall-off prevention hook for preventing the aforementioned output gear, which is meshed with the aforementioned cam gear, from being dismounted from the aforementioned output shaft is provided on the outside surface of the aforementioned motor mounting pedestal, thereby preventing the aforementioned output gear from being dismounted from the aforementioned output shaft even if the motor cover is turned upside down.

It can be cited as one of the characteristics of the present invention that the aforementioned cam gear comprises a sector gear having a portion without teeth, and only the radial length of the portion without teeth is formed to be shorter than the length from the aforementioned rotational shaft to the aforementioned motor mounting pedestal facing the aforementioned cut-out portion.

According to the above, the portion without teeth is aligned with the motor mounting pedestal facing the cut-out portion, and the cam gear is inserted into the cam gear housing recess and rotated, thereby preventing the cam gear from being dismounted from the cam gear housing recess thereafter.

In the present invention, it is preferable that the aforementioned cam gear is provided with a see-through hole through which the inside of the aforementioned cam slot is seen from the other side face thereof, thereby enabling the assembling operation while watching the positional relationship between the cam slot and the lever through the see-through hole.

Further, it is preferable that a stopper means for regulating the place where the aforementioned cam gear rotates is provided between the aforementioned cam gear and the aforementioned cam gear housing recess, thereby enabling accurate setting of the rotational range of the wind directing plate.

In the present invention, it is preferable that an engaging hook for engagingly retaining a suspending wire extending from the aforementioned main body housing side is provided at a side including the corner portion, on which the aforementioned motor cover is mounted, of the aforementioned front panel, thereby enabling to suspend the front panel at the main body housing as well as to locate the motor cover, specifically, the wind directing plate driving means, nearer the main body housing, thereby the shortest leading wiring can be realized.

In the present invention, it is preferable that the aforementioned coupling means for coupling each of the aforementioned wind directing plates is either of a hook type of universal joint or a flexible universal joint, and these joints are available comparatively at low price with ease.

In order to reduce the number of components, in the present invention is characterized by a rib plate having a U-shaped shaft bearing slot for holding the rotational shaft of the aforementioned wind directing plate is formed at the aforementioned front panel, and a sleeve bush for engaging in the aforementioned shaft bearing slot is integrally formed at a joint member of the aforementioned universal joint attached to the aforementioned rotational shaft.

In order to reduce the number of components as in the above, in the present invention is characterized by a holding portion for engaging in the aforementioned shaft bearing slot and holding the aforementioned sleeve bush is integrally formed at the aforementioned motor cover.

In the present invention it is preferable that with the corner portion, on which the aforementioned wind directing plate driving means is disposed, of the aforementioned front panel being referred to as a first corner portion, a fourth corner portion located on the diagonal line seen from the first corner portion side is provided with first spring means for giving momentum in a direction to close two of the aforementioned wind directing plates adjacent to the fourth corner portion, thereby enabling to reduce load on the motor, and preventing the wind directing plates from rattling.

In order to reduce load on the motor and prevent the wind directing plates from rattling, it is also preferable that with the corner portion, on which the aforementioned wind directing plate driving means is disposed, of the aforementioned front panel being referred to as the first corner portion, a second and a third corner portions which are opposing corner portions at the respective sides adjacent to the first corner portion are respectively provided with second spring means for giving momentum to each of the aforementioned wind directing plates in a predetermined direction.

It is suitable to use both of the first and second spring means. Specifically, it is suitable that with the corner portion, on which the aforementioned wind directing plate driving means is disposed, of the aforementioned front panel being referred to as the first corner portion, the fourth corner portion located on the diagonal line seen from the first corner portion side is provided with the first spring means for giving momentum in a direction to close two of the aforementioned wind directing plates adjacent to the fourth corner portion, and the second and the third corner portions which are opposing corner portions at the respective sides adjacent to the first corner portion are respectively provided with the second spring means for giving momentum to each of the aforementioned wind directing plates in a predetermined direction.

The aforementioned first spring means may be two of springs respectively attached at the rotational shafts disposed at the foremost ends of two of the aforementioned wind directing plates adjacent to the aforementioned fourth corner portion. When the rotational shafts disposed at the foremost ends of two of the aforementioned wind directing plates adjacent to the aforementioned fourth corner portion are coupled to each other with a universal joint, the aforementioned first spring means may be only one spring acting on the universal joint.

In the present invention, only one spring acting on a universal joint as a coupling means for coupling the aforementioned wind directing plates in each of the corner portions is applied for each of the aforementioned second spring means disposed on the aforementioned second and third corner portions.

In the present invention, the aforementioned air fan is controlled to be actuated after the aforementioned wind directing plates are held at a predetermined open angular position from totally closed position thereof by the aforementioned wind directing plate driving means on starting the operation. Thereby preventing increase in load on the wind directing plate driving means caused by air blowing at the totally closed position of the wind directing plates.

BRIEF DESCRIPTION OF THE DRAWINGS

FIG. 25 is an exploded perspective view showing a wind directing plate driving means mounted on the front panel in the aforementioned conventional art;

FIG. 26 is a schematic sectional view of the wind directing plate driving means in the aforementioned conventional art; and FIG. 27 is a perspective view showing the shaft supporting condition of the wind directing plate in the aforementioned conventional art.

DETAILED DESCRIPTION OF THE PREFERRED EMBODIMENT(S)

Figure 1:
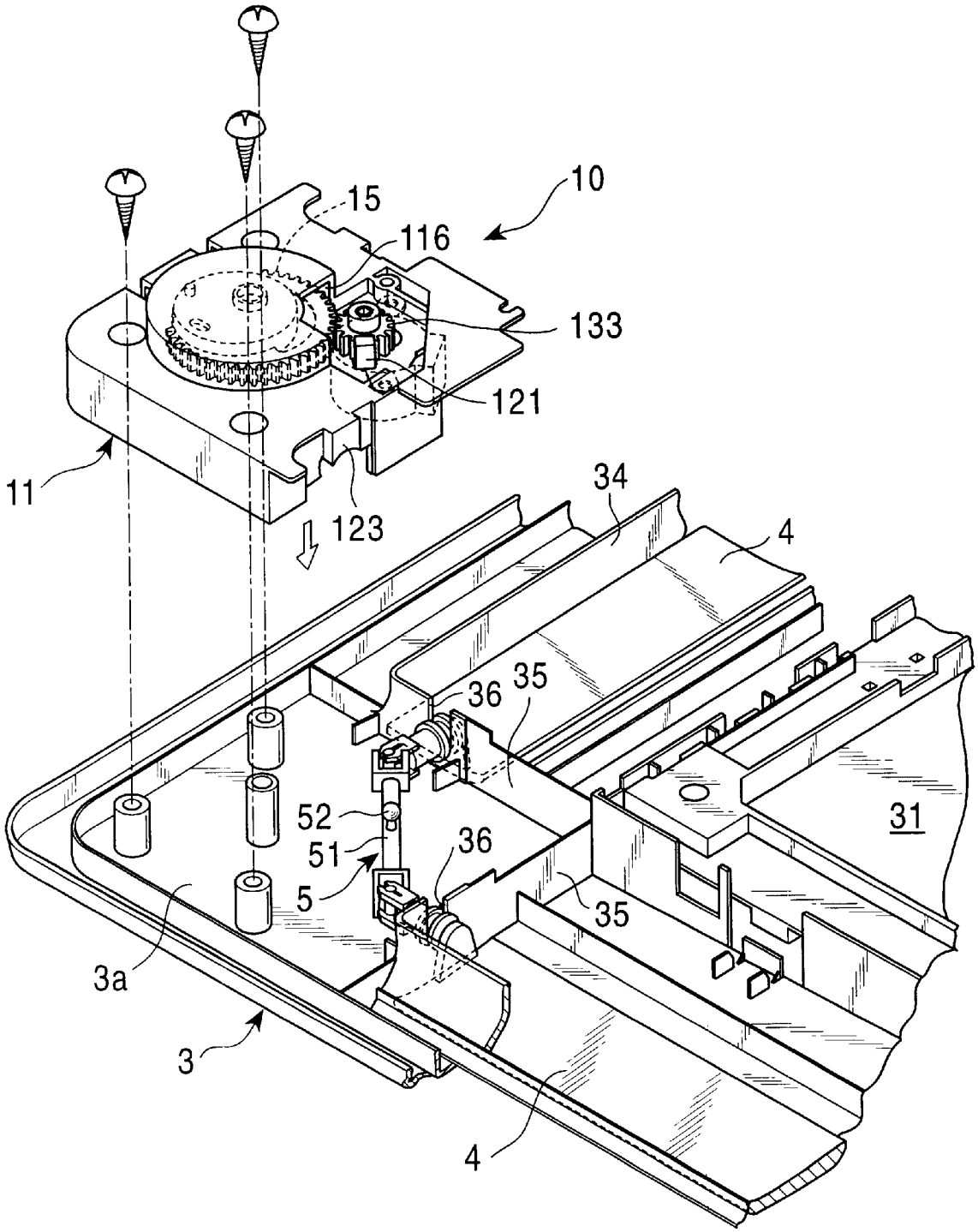
FIG. 1 is an embodiment of the present invention, and a perspective view of a mounting portion of a wind directing plate driving means in a front panel from a main body housing side.

In the embodiments described below, a main body housing embedded in a ceiling is also included, and there is no difference in the main body housing from that in the conventional art explained above, therefore the explanation will be omitted. As for the other elements, those which are the same, or considered to be the same as in the conventional embodiment explained above are given the same reference numerals and signs as those in the conventional embodiment.

FIG. 1 is a perspective view of a portion for mounting a wind directing plate driving means 10 in a front panel 3, which is seen from the main body housing 2 side. FIG. 1 shows only a part of the front panel 3, and at the front panel 3, wind directing plates 4 coupled to each other with a hook type of universal joint 5 are rotatably disposed in respective air outlets 34 similarly to the conventional embodiment explained in the above.

The wind directing plate driving means 10 is also provided on a predetermined corner portion 3*a* of the front panel 3 in the present invention, and in this case, the wind directing plate driving means 10, which has been previously assembled in a different place, is mounted on the front panel 3.

Figure 2:
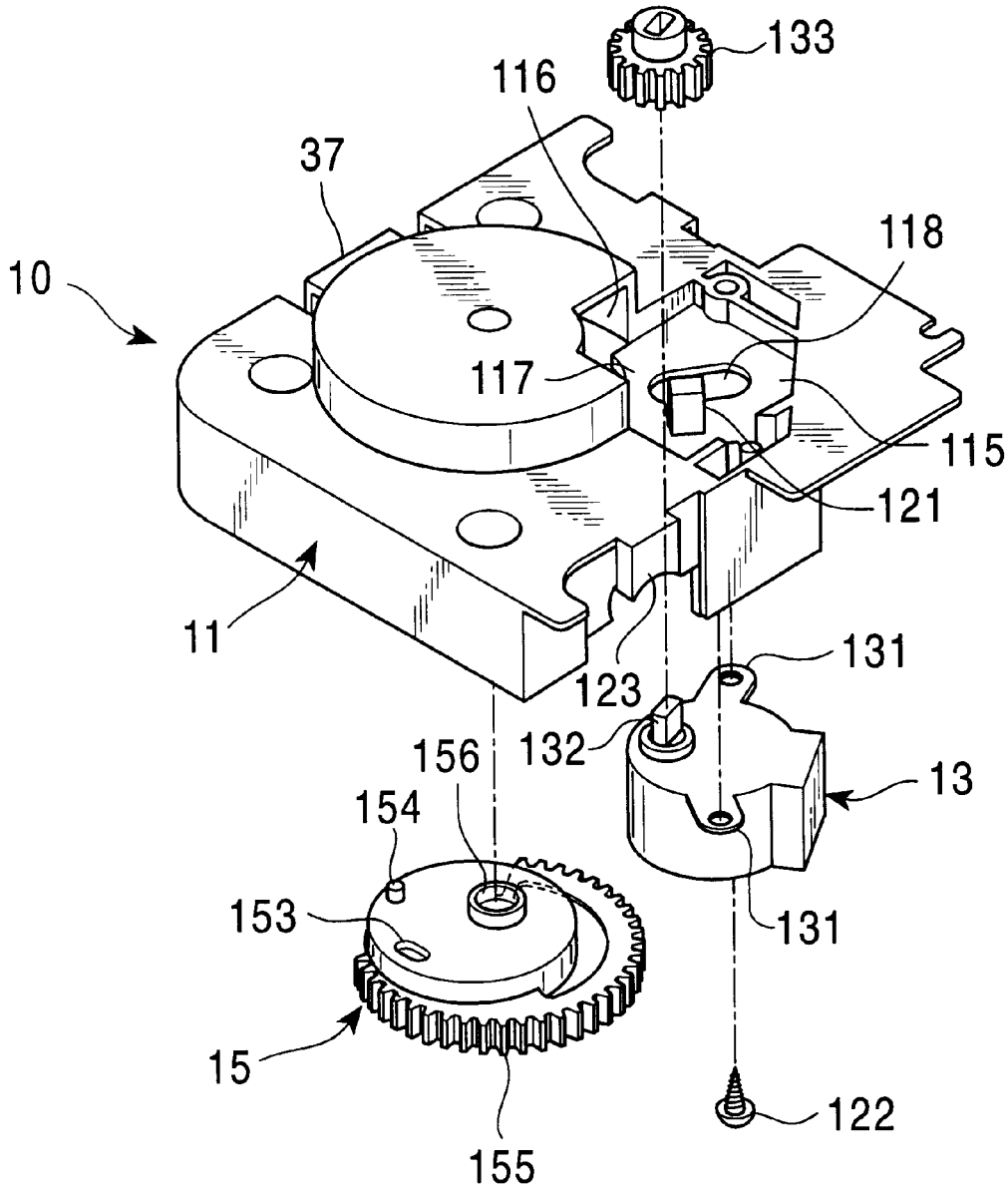
FIG. 2 is an exploded perspective view of the wind directing plate driving means seen from the same side as in FIG. 1.
Figure 3:
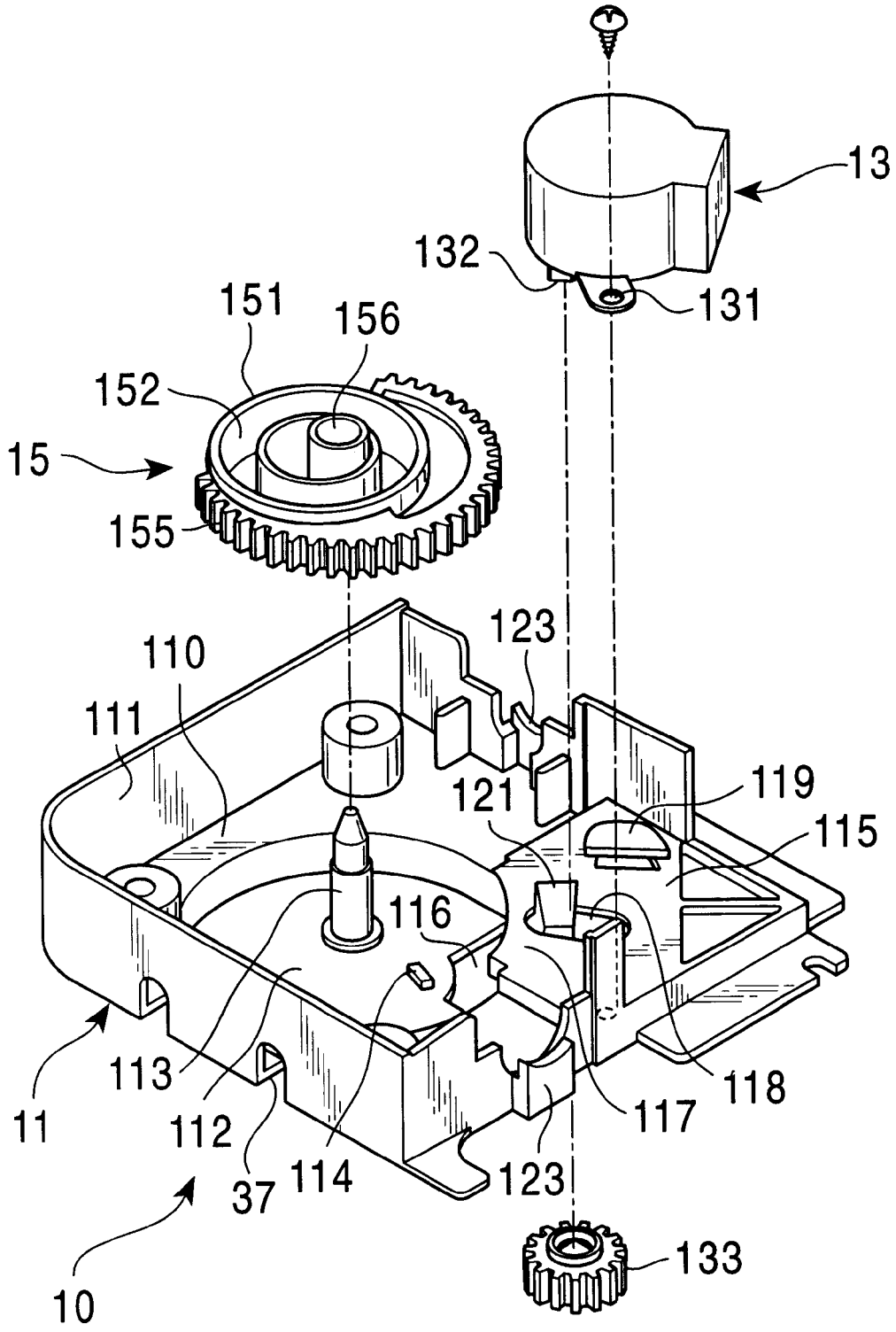
FIG. 3 is an exploded perspective view of the same wind directing plate driving means which is turned upside down contrary to FIG. 2.

FIG. 2 is an exploded perspective view of the wind directing plate driving means 10 seen from the same side as in FIG. 1, and FIG. 3 is an exploded perspective view of the wind directing plate driving means 10 seen from the opposite side to the above.

According to the above, the wind directing plate driving means 10 includes a motor cover 11, and a motor 13 and a cam gear 15 are placed therein with the motor cover 11 as a base. The motor cover 11 is formed to be a box-shaped body including a parts mounting base plate 110 and a side plate 111 provided around it, with one side face being opened.

A cam gear housing recess 112 in a circular recessed form is formed in the parts mounting base plate 110, and at the center thereof, a rotational shaft 113 of the cam gear 15 is vertically provided. A projection 114 serving as a stopper for limiting the rotational positions of the cam gear 15 is provided at the bottom portion of the cam gear housing recess 112.

A motor mounting pedestal 115 is formed on the parts mounting base plate 110 to be adjacent to the cam gear housing recess 112. Looking at the condition in FIG. 3, the motor mounting pedestal 115 is raised higher than the parts mounting base plate 110.

The cam gear housing recess 112 includes a cut-out portion 116 in the portion facing the motor mounting pedestal 115. An end portion 117 of the motor mounting pedestal 115 is pushed out to the cut-out portion 116 side.

Figure 4:
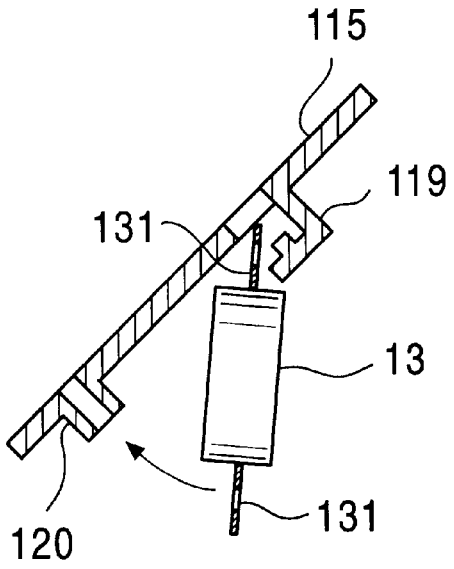
FIG. 4 is a sectional view taken along the 4,5—4,5 line in FIG. 7A to explain the condition in which a motor is mounted to a motor mounting pedestal.
Figure 5:
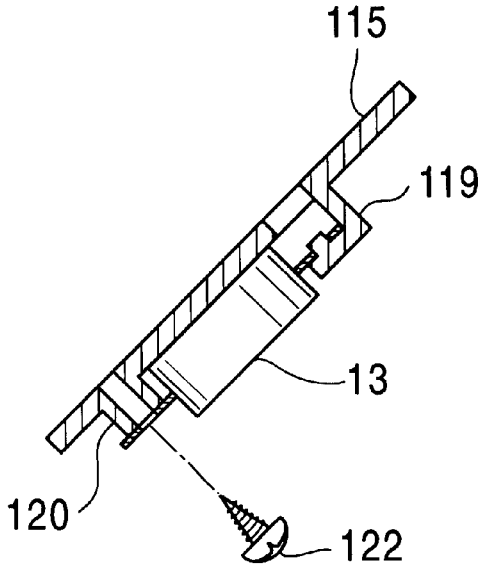
FIG. 5 is a sectional view taken along the IV—IV line in FIG. 7A to explain the condition in which a motor is mounted to a motor mounting pedestal as in FIG. 4.

The motor mounting pedestal 115 is provided with a shaft insertion hole 118 consisting of an oblong extending in the radial direction of the cam gear housing recess 112. A hook 119 and a screw bearing boss 120 for mounting the motor 13 are provided on the inner face side (upper face side in FIG. 3) of the motor mounting pedestal 115 as FIGS. 4 and 5 illustrate. The hook 119 and the screw bearing boss 120 are disposed at both sides of the shaft insertion hole 118.

A fall-off prevention hook 121 for an output shaft 132 attached to the motor 13 is provided on the outer face side (bottom face side in FIG. 3) of the motor mounting pedestal 115 in FIG. 2. The fall-off prevention hook 121 consists of an inverted L-shaped hook having a height a little higher than the thickness of the output gear 133, and is disposed at one side of the shaft insertion hole 118 and near the cam gear housing recess 112.

In the embodiment, the motor 13 is a stepping motor, and mounting flanges 131 and 131 are provided at both sides thereof to the right and the left. The output gear 133 is attached onto an output shaft 132 of the motor 13. At the output shaft 132 and in the shaft hole of the output gear 133, engaging faces parallel to the axes thereof are respectively formed.

A sector gear having a portion without teeth 151 is used as the cam gear 15. As is clearly shown in FIG. 3, a cam slot 152 in a helical shape is formed in one side face (bottom face) of the cam gear 15. The periphery except the portion without teeth 151 is a gear portion 155 meshed with the output gear 133 of the motor 13, and a shaft hole 156 is provided at the center of the cam gear 15.

On the other hand, as FIG. 2 illustrates, a see-through hole 153 is provided in the other side face (top face) of the cam gear 15 in order to see the inside of the cam slot 152 from the other side face. A projection 154 working together with the projection 114 in the cam gear housing recess 112 is formed on the other side face of the cam gear 15.

In this case, only the length in a radial direction of the portion without teeth 151 of the cam gear 15 is formed to be shorter than the length from the rotational shaft 113 to the end portion 117 of the motor mounting pedestal 115 facing the cut-out portion 116.

In this embodiment, each of the wind directing plates 4 is coupled with the hook type universal joint 5, and the lever 52 to be engaged in the cam slot 152 of the cam gear 15 is vertically provided at the main shaft 51 thereof.

Here, with reference to FIGS. 6A and 6B together with FIGS. 7A and 7B, an example of the assembling procedures of the wind directing plate driving means 10 will be explained.

First, as shown in FIG. 3, the motor cover 11 is turned upside down, and the cam gear 15 is inserted into the cam gear housing recess 112. Specifically, with the portion without teeth 151 of the cam gear 15 facing the end portion 117 of the motor mounting pedestal 115, the shaft hole 156 is slid onto the rotational shaft 113, and the cam gear 15 is slipped into the cam gear housing recess 112.

Thereafter, the portion without teeth 151 is moved aside from the cutout portion 116 by rotating the cam gear 15 in order that the gear portion 155 stays in the cut-out portion 116. As a result the edge of the gear portion 155 is located on the end portion 117 of the motor mounting pedestal 115, therefore the cam gear 15 does not fall out of the cam gear housing recess 112 even if the motor cover 11 is turned over from the position in FIG. 3 to that as in FIG. 2.

Next, the motor 13 is mounted to the inside face of the motor mounting pedestal 115. First, as shown in FIG. 4, after one of the mounting flanges 131 of the motor 13 is engaged with the hook 119, the other mounting flange 131 is moved in a direction to lift it up in FIG. 4, and the output shaft 132 is projected from the shaft insertion hole 118 to the outside of the motor mounting pedestal 115.

Figure 6A:
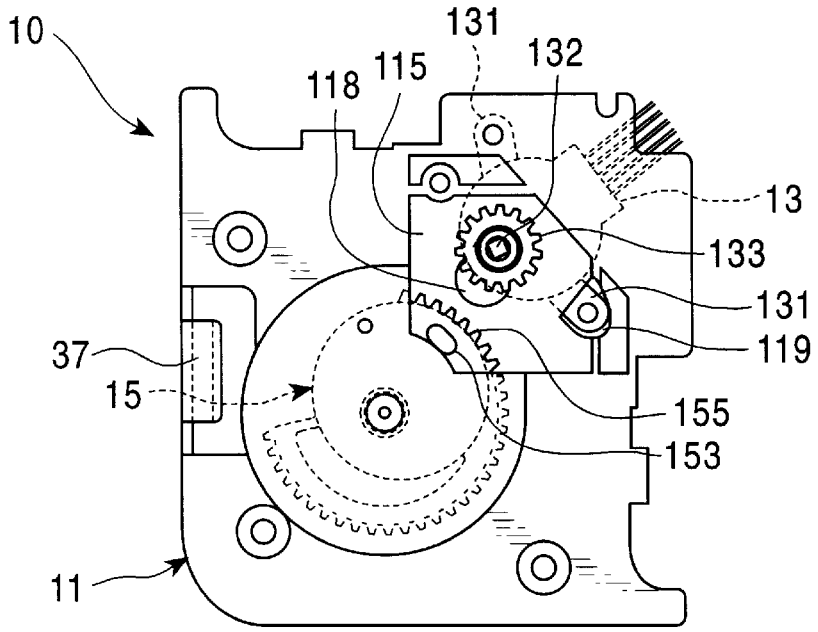
FIG. 6A is a plan view for explaining the condition in which the motor and a cam gear are mounted in a motor cover.
Figure 6B:
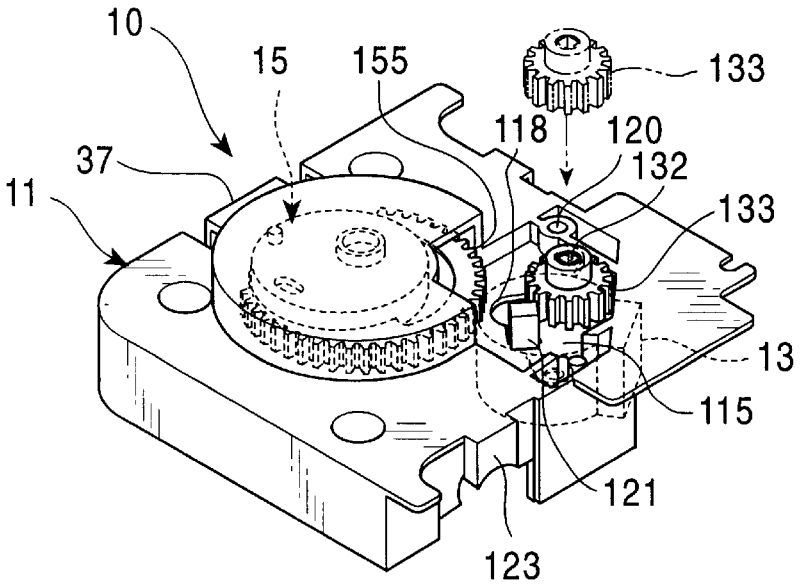
FIG. 6B is a perspective view thereof.
Figure 7A:
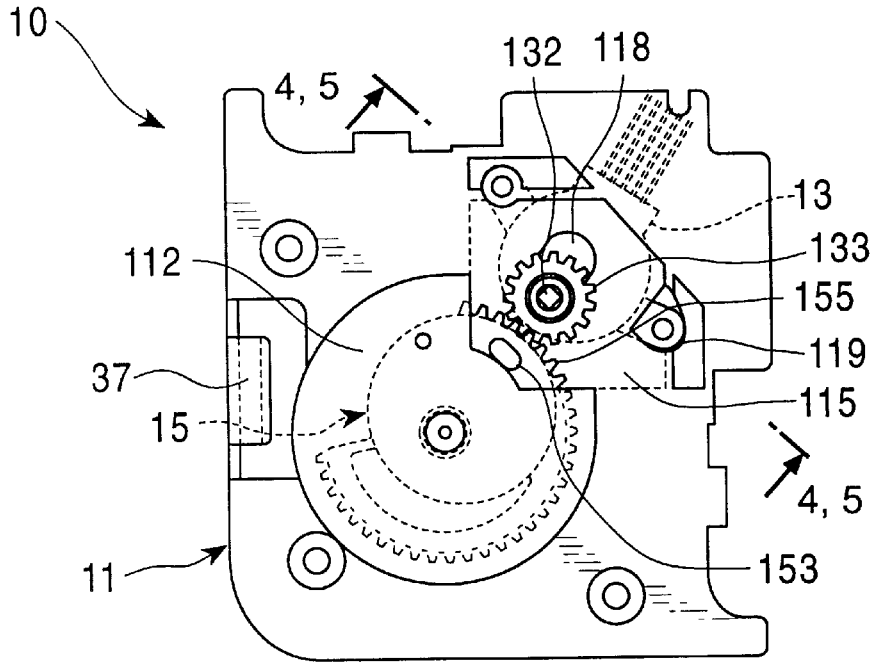
FIG. 7A is a plan view for explaining the condition in which the motor and the cam gear are mounted in a motor cover as in FIG. 6A.

At this time, as shown in FIGS. 6A and 6B, the output shaft 132 is moved in a direction away from the cam gear 15, and at this position, the output gear 133 is attached onto the output shaft 132. By rotating the motor 13 itself around the hook 119 along the motor mounting pedestal 115, the output gear 133 is meshed with the gear portion 155 of the cam gear 15 as shown in FIGS. 7A and 7B, and the other mounting flange 131 is fastened to the screw bearing boss 120 with a screw 122 as shown FIG. 5.

Figure 7B:
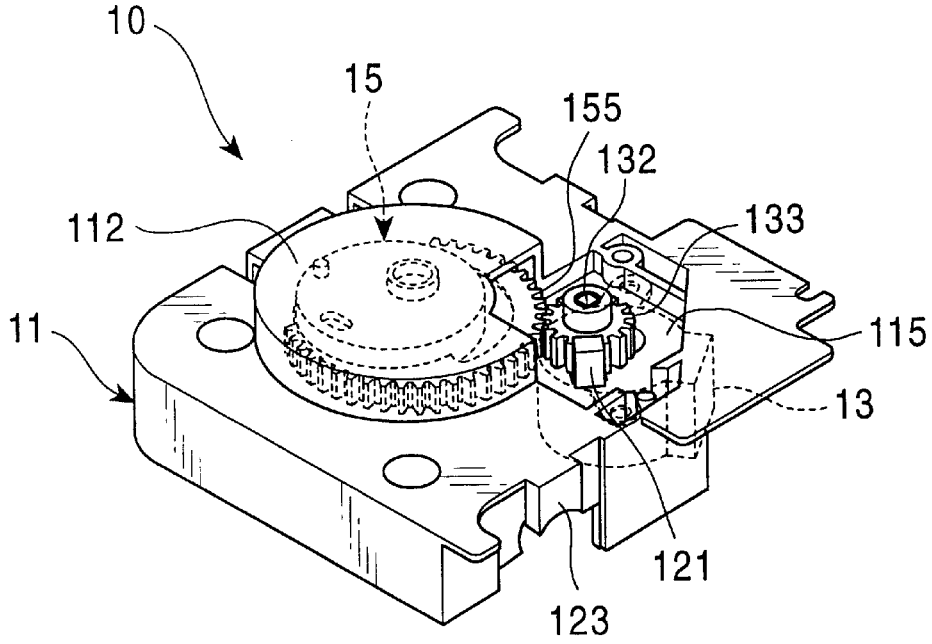
FIG. 7B is a perspective view thereof as in FIG. 6B.

In this way, the present invention allows easy adjustment of the distance between the shafts of the output gear 133 and the gear portion 155, and in this meshing position, a part of the output gear 133 enters into the inverted L-shaped fall-off prevention hook 121 as shown in FIG. 7B, therefore the output gear 133 does not come off the output shaft 132 thereafter.

After the wind directing plate driving means 10 is assembled with the motor cover 11 as a base as described above, the wind directing plate driving means 10 is mounted on the corner portion 3*a* of the front panel 3, and at this time, the see-through hole 153 is placed in the cut-out portion 116 by rotating the cam gear 15.

Figure 8:
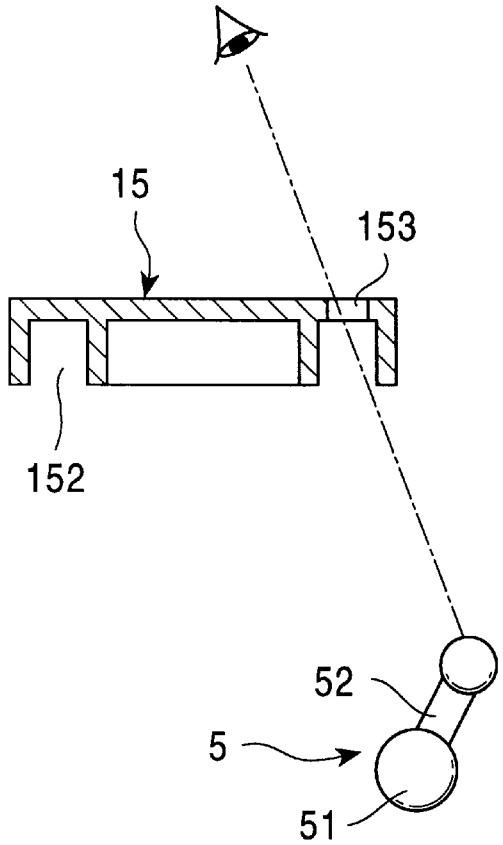
FIG. 8 is an explanatory diagram of the operation of a see-through hole provided at the cam gear.

Thereby the position of the lever 52 of the hook type universal joint 5 side can be confirmed through the see-through hole 153 as illustrated in a schematic form in FIG. 8, therefore the lever 52 can be easily guided into the cam slot 152.

The see-through hole 153 is provided at the position at an angle of about 180 degrees relative to the portion without teeth 151, therefore after the cam gear 15 is attached in the cam gear housing recess 122, by rotating the cam gear 15 about 180 degrees, the see-through hole 153 appears in the cutout portion 116, and this position is the initial position of the wind directing plate 4, that is, a totally closed position.

Figure 9:
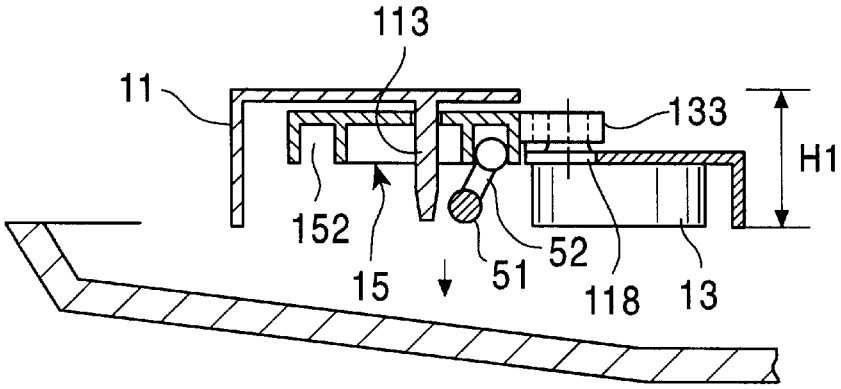
FIG. 9 is a schematic sectional view of the wind directing plate driving means.

FIG. 9 shows a schematic sectional view of the wind directing plate driving means 10 mounted on the front panel 3 as described above. As is obvious from FIG. 9, according to the present invention, the output gear 133 of the motor 13 and the cam gear 15 are disposed on the motor cover 11 almost parallel to each other, therefore the height H1 of the entire body of the wind directing plate driving means 10 can be made lower than the conventional height H (see FIG. 26), which means that the front panel 3 itself can be formed to be slimmer.

Figure 10A:
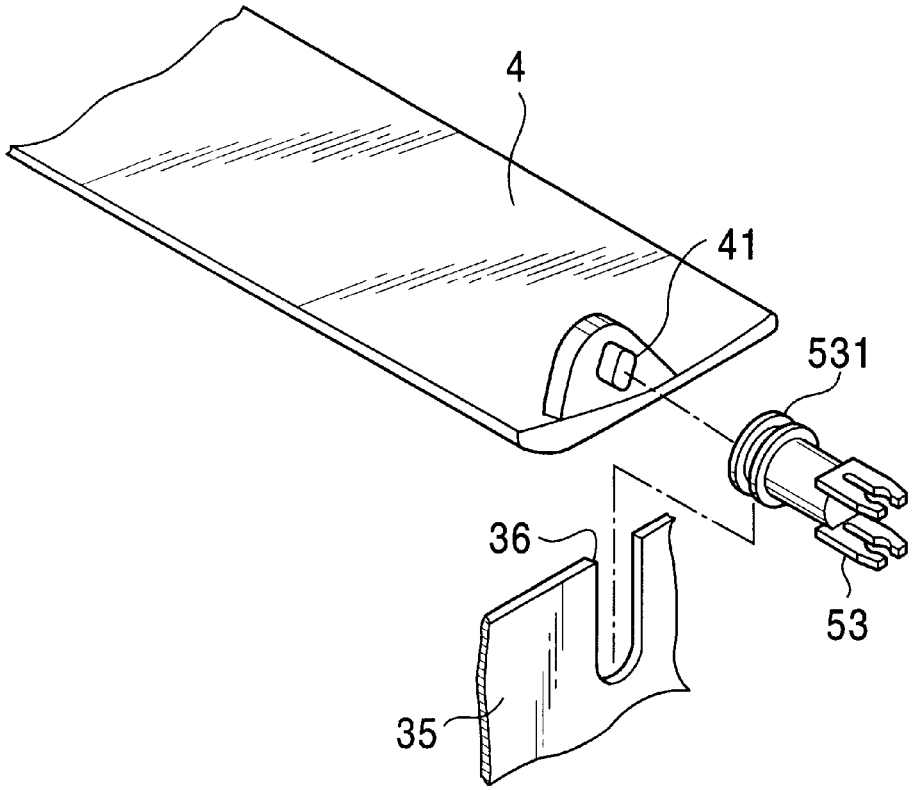
FIG. 10A is an exploded perspective view explaining the condition in which a sleeve bush is integrally formed at a shaft portion of a joint member attached to a rotational shaft of the wind directing plate.
Figure 10B:
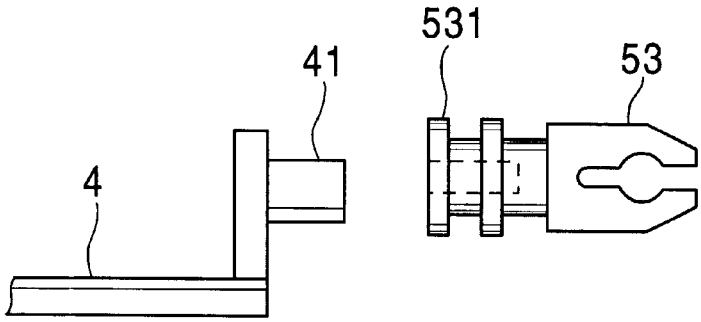
FIG. 10B is a side view thereof.

In the present invention, in order to decrease the number of parts, a sleeve bush 531 is integrally formed at the shaft portion of a joint member 53 attached to a rotational shaft 41 of the wind directing plate 4 as shown in a perspective view in FIG. 10A and in a side view in FIG. 10B.

The joint member 53 including the sleeve bush 531 is preferably formed of synthetic resin (for example, polyacetal resin containing lubricant component) of low friction with self-lubricity for convenience of engaging the sleeve bush 531 in the shaft bearing slot 36 of the front panel 3 side.

Relating to the above, in the present invention, in order to further reduce the number of parts, as shown in, for example FIG. 2 or FIG. 3, the holding portion 123 for preventing disengagement, which is engaged in the shaft bearing slot 36 to hold the sleeve bush 531 is integrally formed at a part of the side plate 111 of the motor cover 11.

Figure 11:
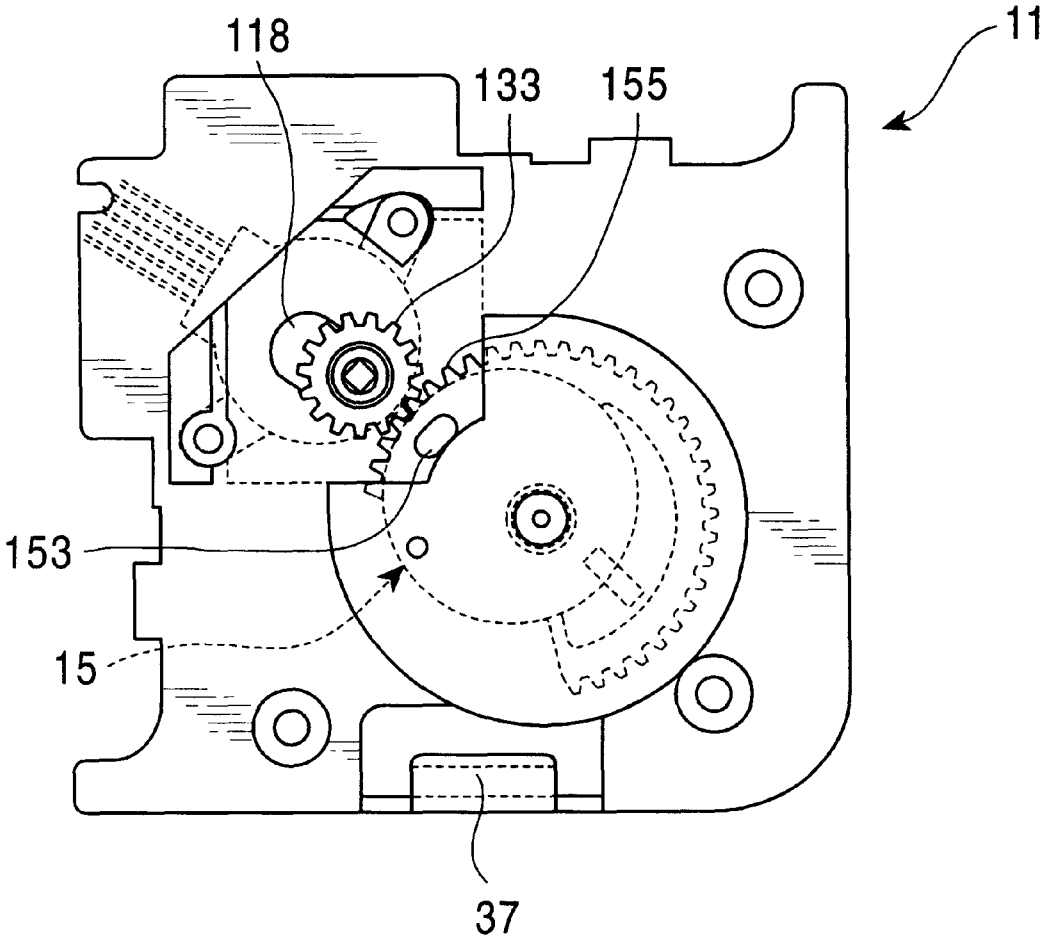
FIG. 11 is a plan view showing an engaging hook provided at a side of the front panel at the wind directing plate driving means side.
Figure 12:
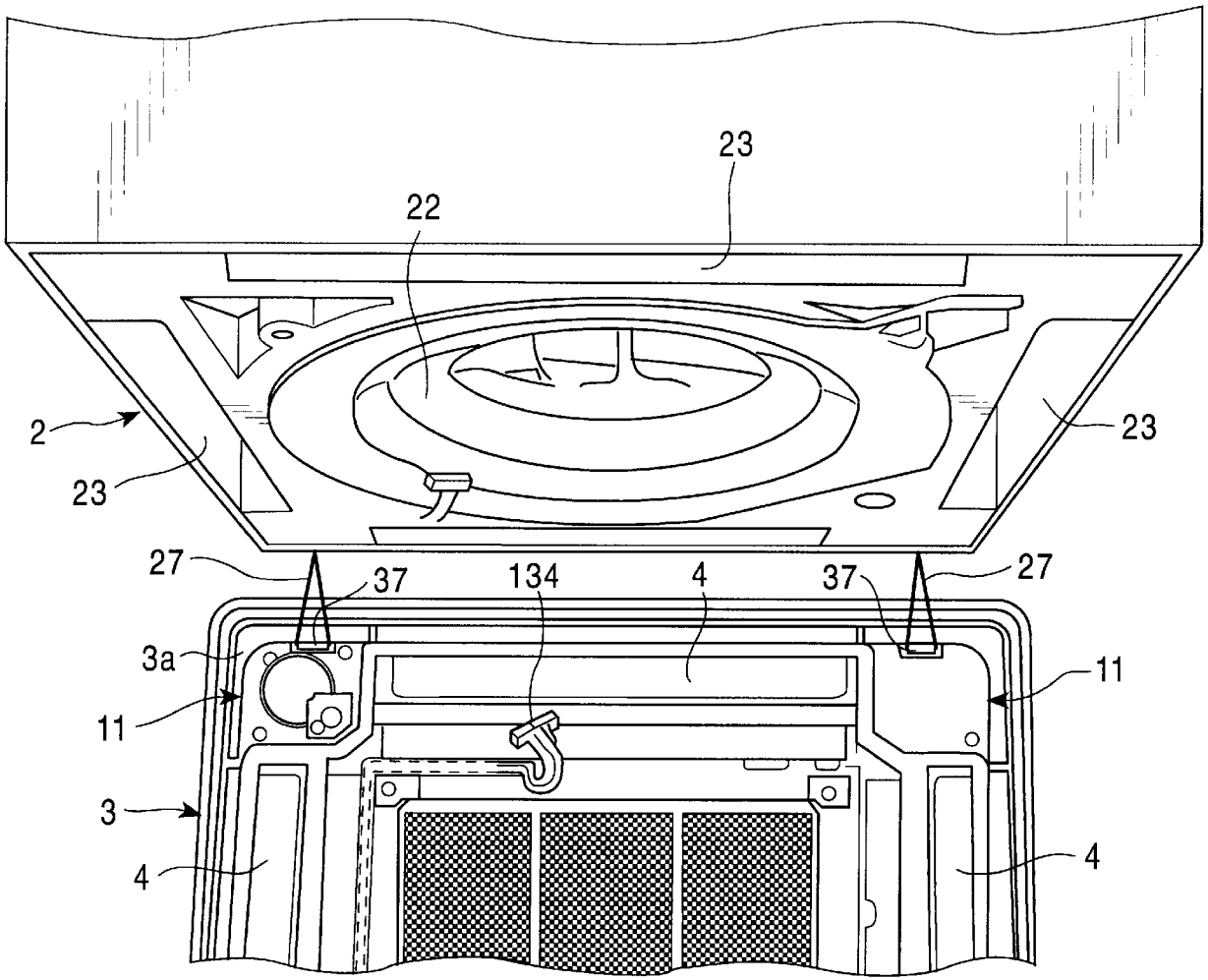
FIG. 12 is an explanatory view showing the condition in which the front panel is suspended at a main body housing by means of the aforementioned engaging hook.

In the present invention, as shown in FIGS. 11 and 12, an engaging hook 37 for engagingly retaining a suspending wire 27 extending from the main body housing 2 side is provided at a side including the corner portion 3*a* of the front panel 3 on which the motor cover 11 is mounted.

The front panel 3 is dismounted from the main body housing 2 and is suspended by the suspending wire 27, when, for example, a filter 32 is cleaned, or replaced. In the present invention, the engaging hook 37 is provided at a side including the corner portion 3*a* where the motor cover 11 is mounted while the motor cover 11, that is, the wind directing plate driving means 10 is placed near the main body housing 2, therefore a leading wiring of the motor 13, a wire harness 134 of the motor 13 in this embodiment can be the shortest length relative to the main body housing 2.

Figure 13:
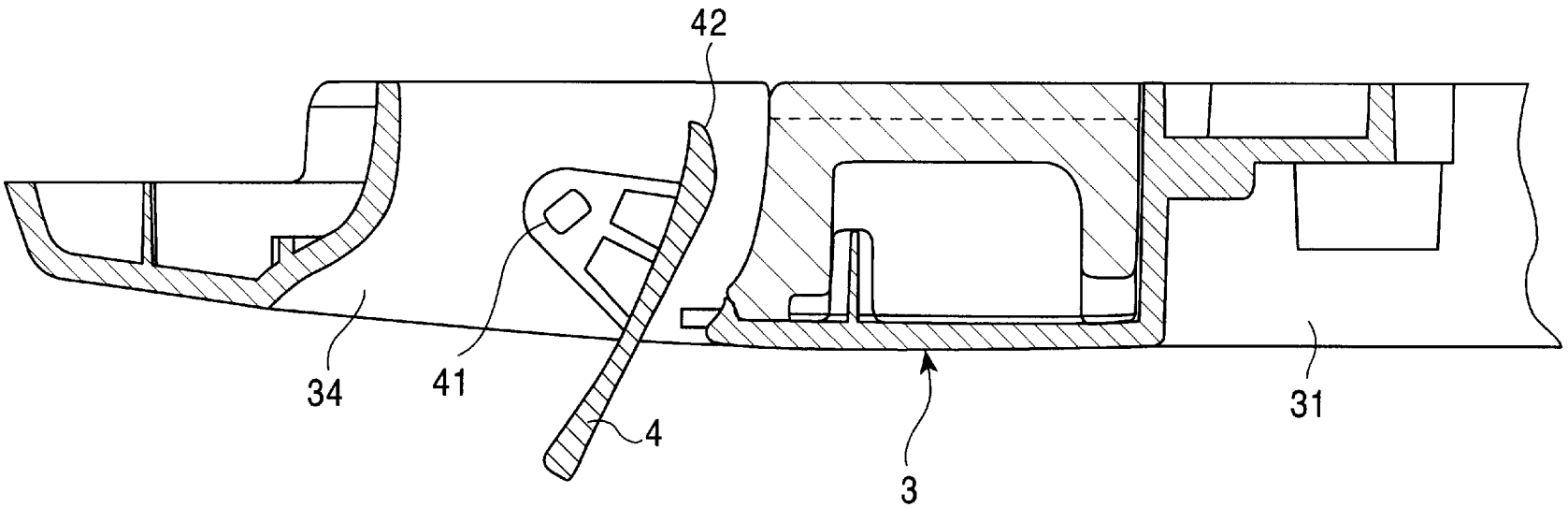
FIG. 13 is a sectional view showing the wind directing plate in an air outlet.

Incidentally, in order to form the front panel 3 to be much thinner, as shown in FIG. 13, it is preferable to place the rotational shaft 41 of the wind directing plate 4 near the air outlet 31 side. In doing so, an end portion 42 of the rear end side of the wind directing plate 4 isn't placed farther inside the housing 2 than necessary, and the front panel 3 can be thinner for that. However, on the other hand, if doing as in the above, moment weight on the motor 13 increases especially when the wind directing plate 4 is held at its totally closed position, and load on the motor 13 is increased.

Figure 14:
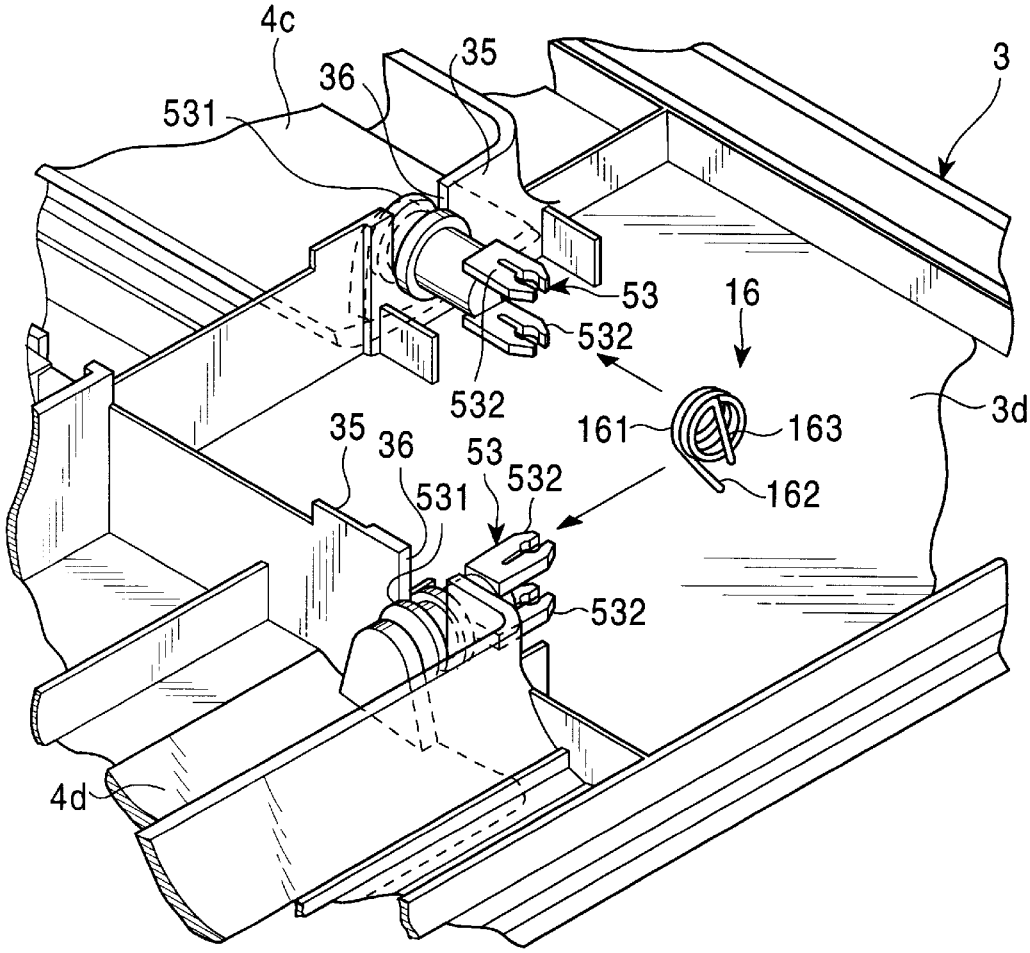
FIG. 14 is a perspective view showing the condition in which a spring is attached to the wind directing plates disposed at the foremost end seen from the wind directing plate driving means side.

Accordingly, in the present invention, as shown in FIG. 14 where the corner portion 3*a* of the front panel 3 on which the wind directing plate driving means 10 is mounted is referred to as a first corner portion, a spring 16 for giving momentum in a direction to close two of wind directing plates 4*c* and 4*d* at the end adjacent to a fourth corner portion 3*d* is provided at the fourth corner portion 3*d* located on the diagonal line seen from the first corner portion 3*a*. In this embodiment, each one of the springs 16 is attached to each of the joint members 53 and 53 of the wind directing plates 4*c* and 4*d*.

Figure 15:
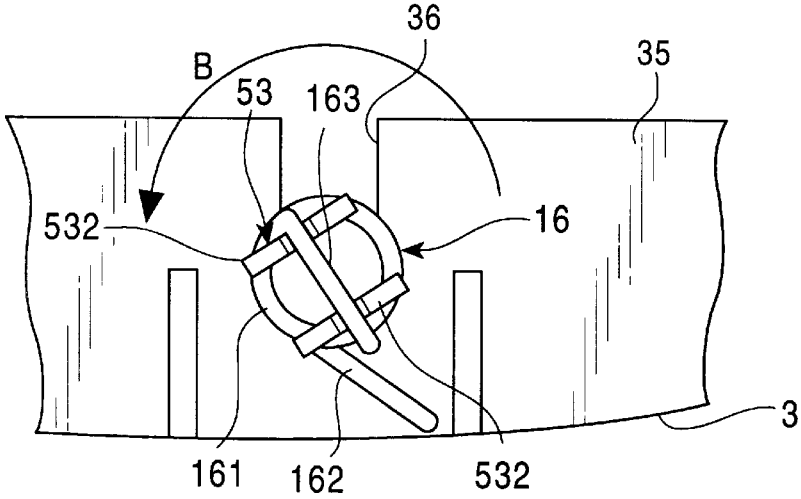
FIG. 15 is a side view of the condition in which the aforementioned spring is attached to a joint member of the wind directing plate.

Referring to FIG. 15 in addition, the spring 16 has a coil portion 161 fitted onto the shaft portion of the joint member 53, a base end foot 162 drawn almost in a straight line from one end of the coil portion 161 so as to abut to the inner face of the front panel 3, and an engaging portion 163 which is drawn from the other end of the coil portion 161, and which is bent so as to engage in a hook portion 532 of the joint member 53. In a normal condition, the spring 16 gives momentum to the wind directing plates 4*c* and 4*d* in a direction of an, arrow B that is, the direction of the totally closed position.

As a result, the rotational shaft 41 of the wind directing plate 4 is placed nearer the air outlet 31 side, and the front panel 3 can be formed to be thinner. In addition, load on the motor 13 is reduced, and rattling of the wind directing plate 4 can be prevented. Further, an inexpensive motor with small pull-in torque (actuating torque) can be applied.

Figure 16:
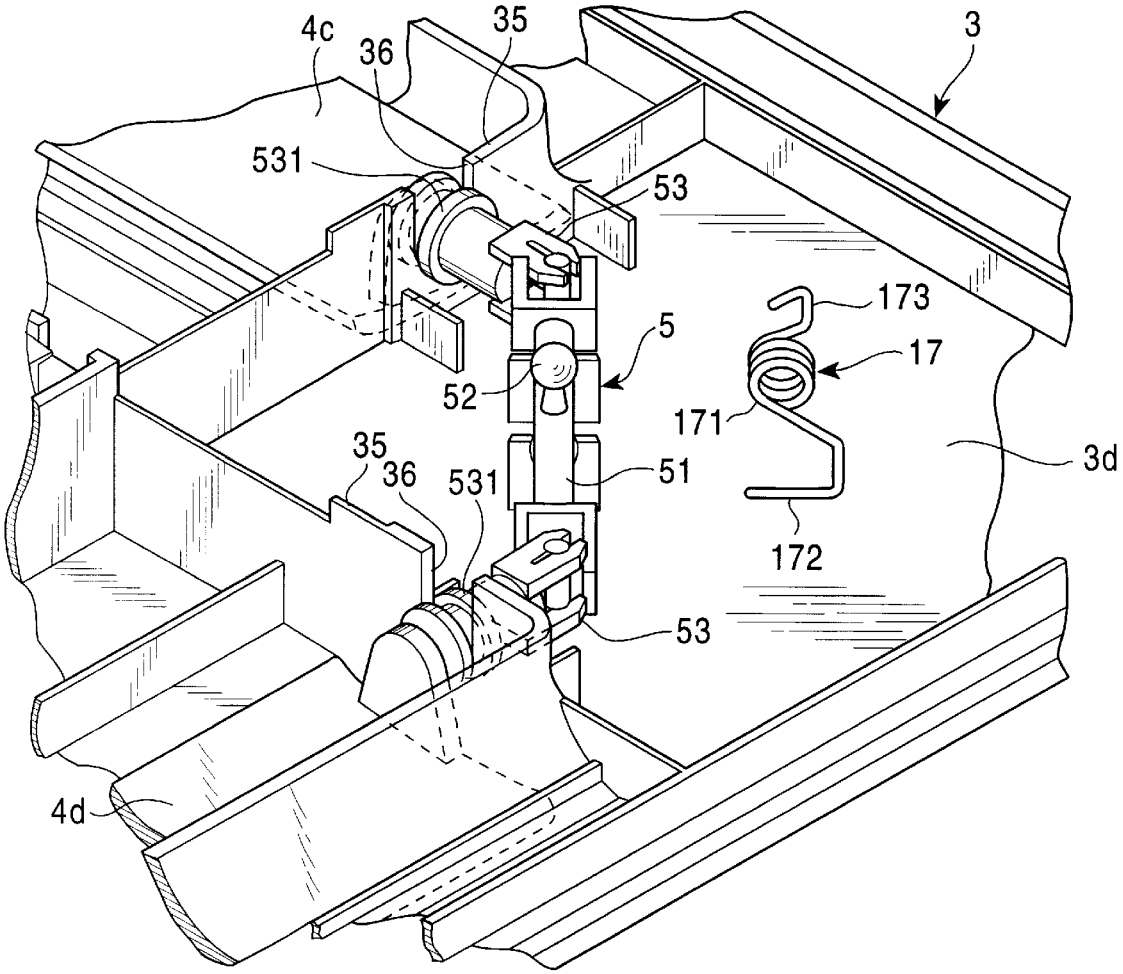
FIG. 16 is a perspective view showing another embodiment in which a spring is attached to the wind directing plates disposed at the foremost end seen from the wind directing plate driving means side.

In the embodiment in FIG. 14, two of the springs 16 are used, but FIG. 16 shows another embodiment in which a spring 17 is used. Specifically, in this embodiment, two of the wind directing plates 4*c* and 4*d* disposed at the foremost end are coupled with the hook type universal joint 5 similarly to the other connecting portions, and only one of the spring 17 is attached to the hook type universal joint 5.

Figure 17:
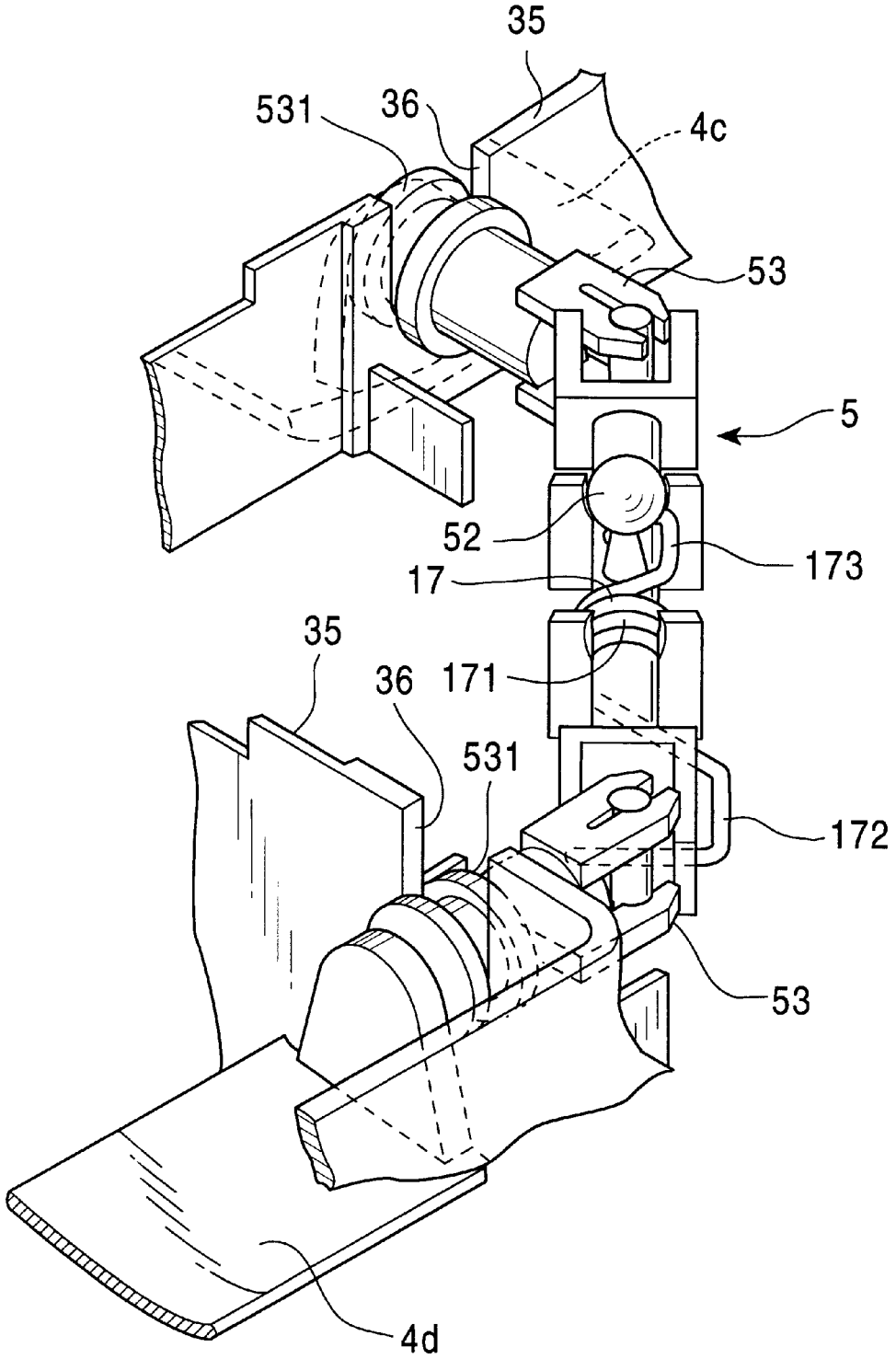
FIG. 17 is a perspective view of the assembling condition in the aforementioned other embodiment.

Referring to FIG. 17 in addition, the spring 17 has a coil portion 171 fitted onto the main shaft 51 of the hook type universal joint 5, a base end foot 172 which is drawn from one end of the coil portion 171, and which is bent so as to abut to the inner face of the front panel 3, and an engaging portion 173 which is drawn from the other end of the coil portion 171, and which is bent so as to engage in the lever 52 of the main shaft 51. Similarly to the aforementioned embodiment, in a normal condition, the spring 17 gives momentum to the wind directing plates 4*c* and 4*d* in the direction of the totally closed position.

Figure 18:
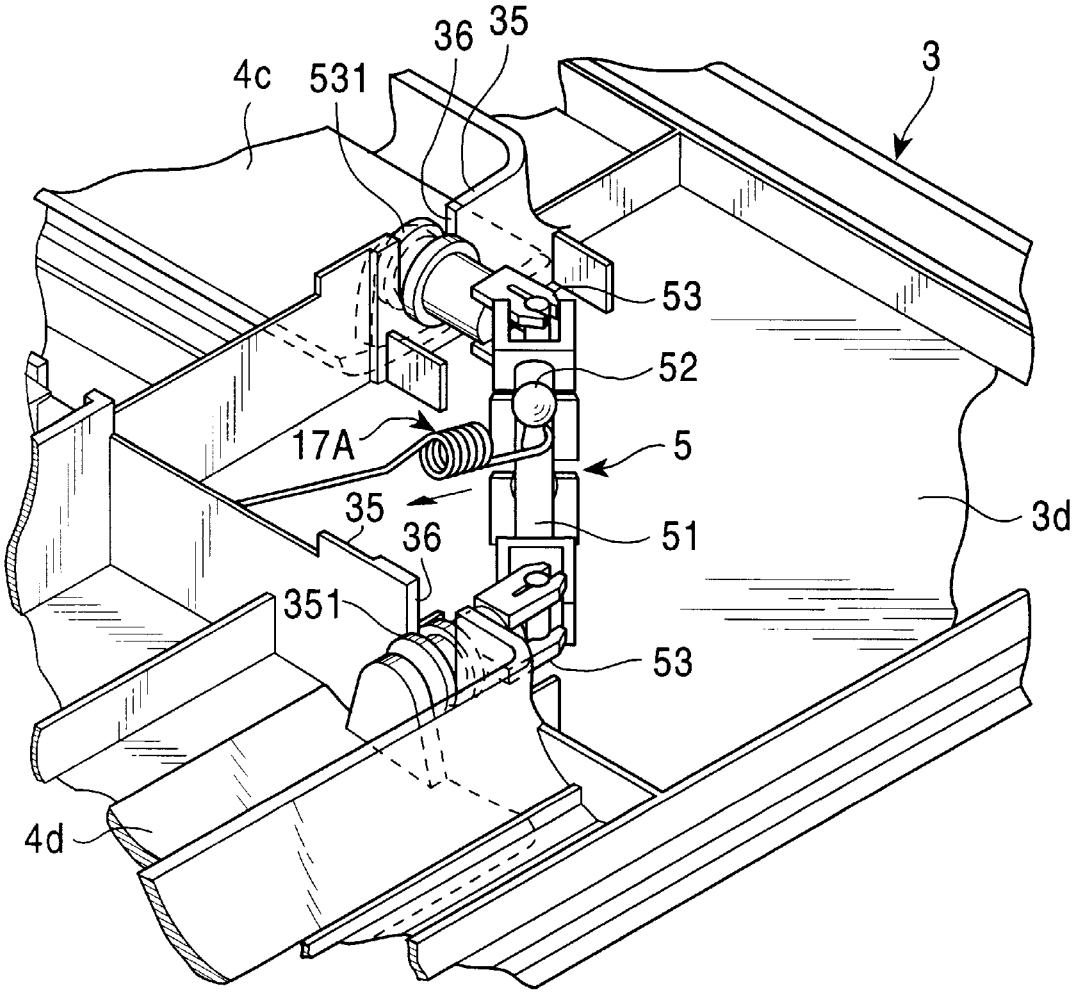
FIG. 18 is a perspective view of an example in which a compression spring is used as the aforementioned spring.

According to the above, only one spring is needed, and the spring force is equally applied on the wind directing plates 4*c* and 4*d* through the hook type universal joint 5, so that adjustment operation after assembling can be easily carried out. Incidentally, as shown in FIG. 18, a compression spring 17A which is usually used in most instances can be used instead of the aforementioned spring 17.

In the aforementioned two embodiments, two of the wind directing plates 4*c* and 4*d* disposed at the foremost ends are coupled with the hook type universal joint 5, and at the coupling portion thereof, the spring 17, or 17A is provided, but the spring 17 (17A) can be provided at the other coupling portions.

Figure 19:
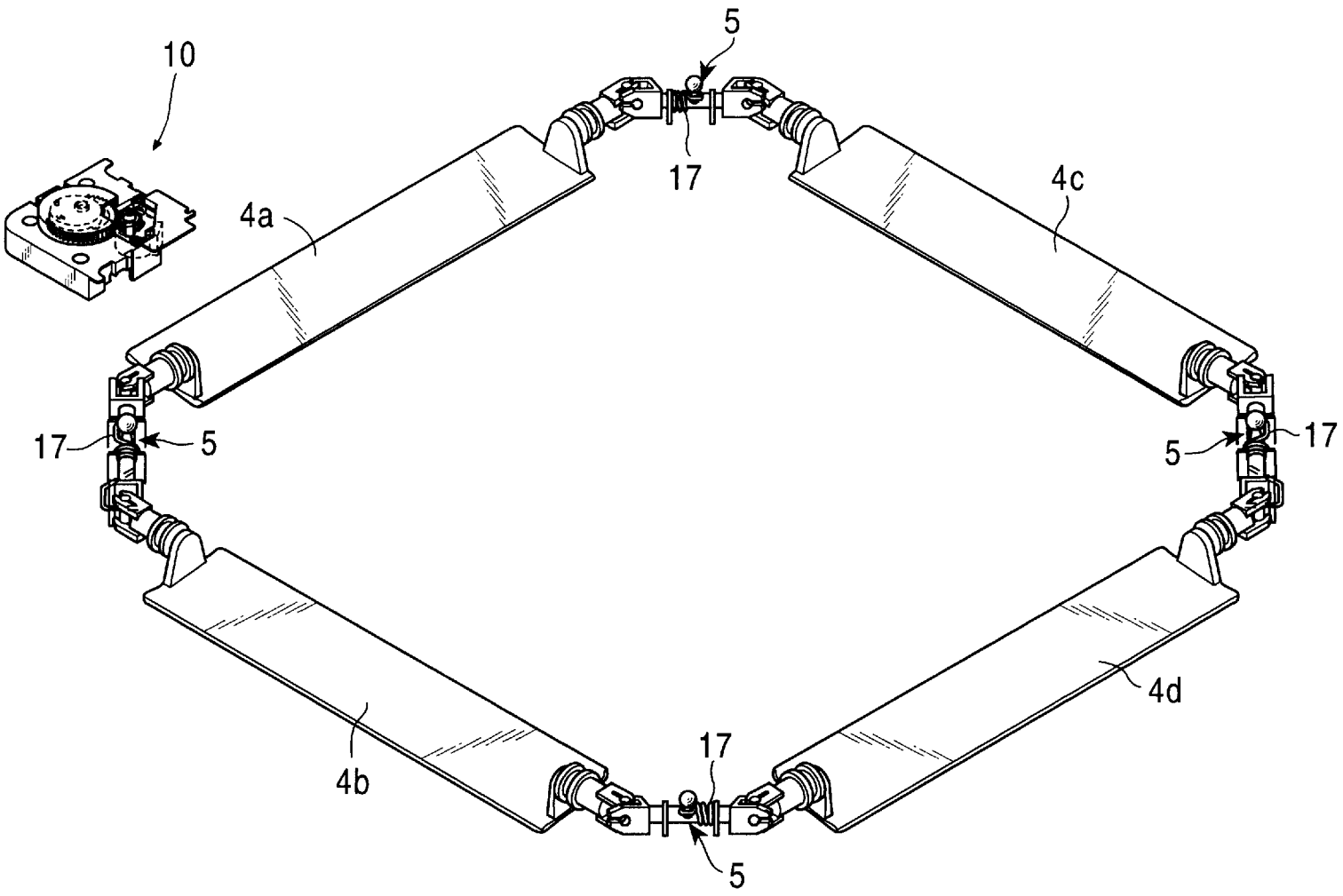
FIG. 19 is a perspective view for explaining the positions at which the aforementioned spring can be additionally placed.

Specifically, as shown in FIG. 19, the spring 17 (17A) may be provided at the hook type universal joint 5 coupling two of the wind directing plates 4*a* and 4*b* adjacent to the wind directing plate driving means 10, or further the spring 17 (17A) may be provided at the hook type universal joints 5 between the wind directing plates 4*a* and 4*c*, and between the wind directing plates 4*b* and 4*d*.

The springs 17 (17A) provided at the corner portions other than the fourth corner portion may give momentum in either direction to close or open the wind directing plates 4, and the direction of the momentum is appropriately selected while watching the operating condition of each of the wind directing plates 4 when each of the wind directing plates 4 is coupled to each other and is actually driven by the motor 13. However when the spring force is given in the direction to open the wind directing plate 4, it needs to be smaller than the detent torque of the motor 13. When the spring force is given in the direction to close the wind directing plate 4, it is required that it is smaller than the spring force given in the direction to open the wind directing plate 4.

Figure 20A:
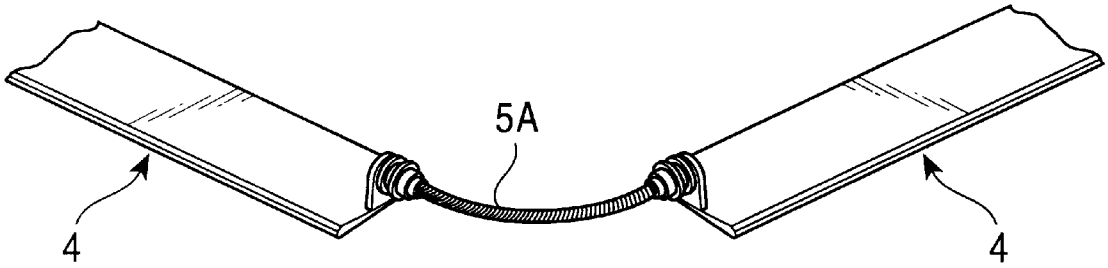
FIGS. 20A and 20B are perspective views showing another coupling means used as coupling means for the wind directing plates.
Figure 20B:
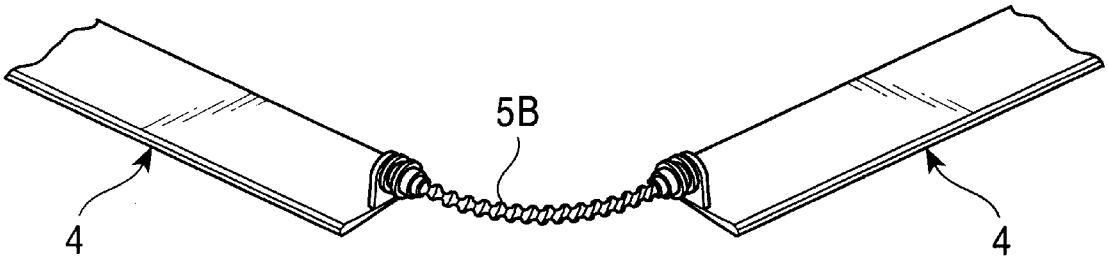

In the aforementioned embodiment, each of the wind directing plates is coupled to each other with the hook type universal joint 5, but the other coupling means, such as a flexible wire 5A as shown in FIG. 20A, or a flexible joint such as a bellows pipe 5B consisting of a hollow blow molding as shown in FIG. 20B may be used. In this kind of flexible joint, it is difficult to mold the lever 52 integrally therewith as the hook type universal joint 5, therefore the lever is attached thereto as a separate part.

Figure 21:
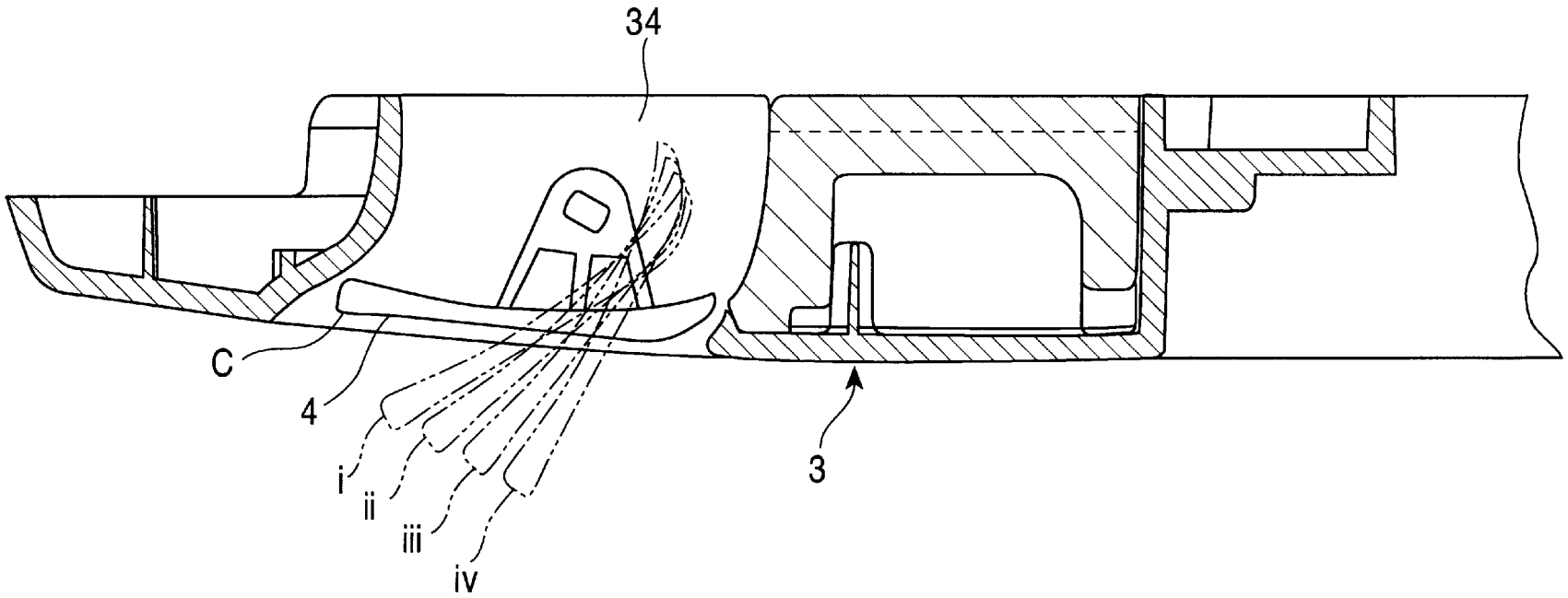
FIG. 21 is a sectional view for explaining the rotational range of the wind directing plate as in FIG. 13.

Next, with reference to FIGS. 21 and 22, angular control of the wind directing plate 4 in the air conditioner will be explained. As for an operational mode, four modes, i.e. a cooling mode, a dehumidification mode, an air blowing mode, and a heating mode are prepared.

The operating angles of the wind directing plate 4 ranges from a totally closed position C via middle set angles (1) to (3) to the maximum open position (4) at which short circuit (a phenomena in which blown air is taken into the air inlet as it is) does not occur, and each of the positions (1) to (4) is set at every 30 degrees.

Figure 22:
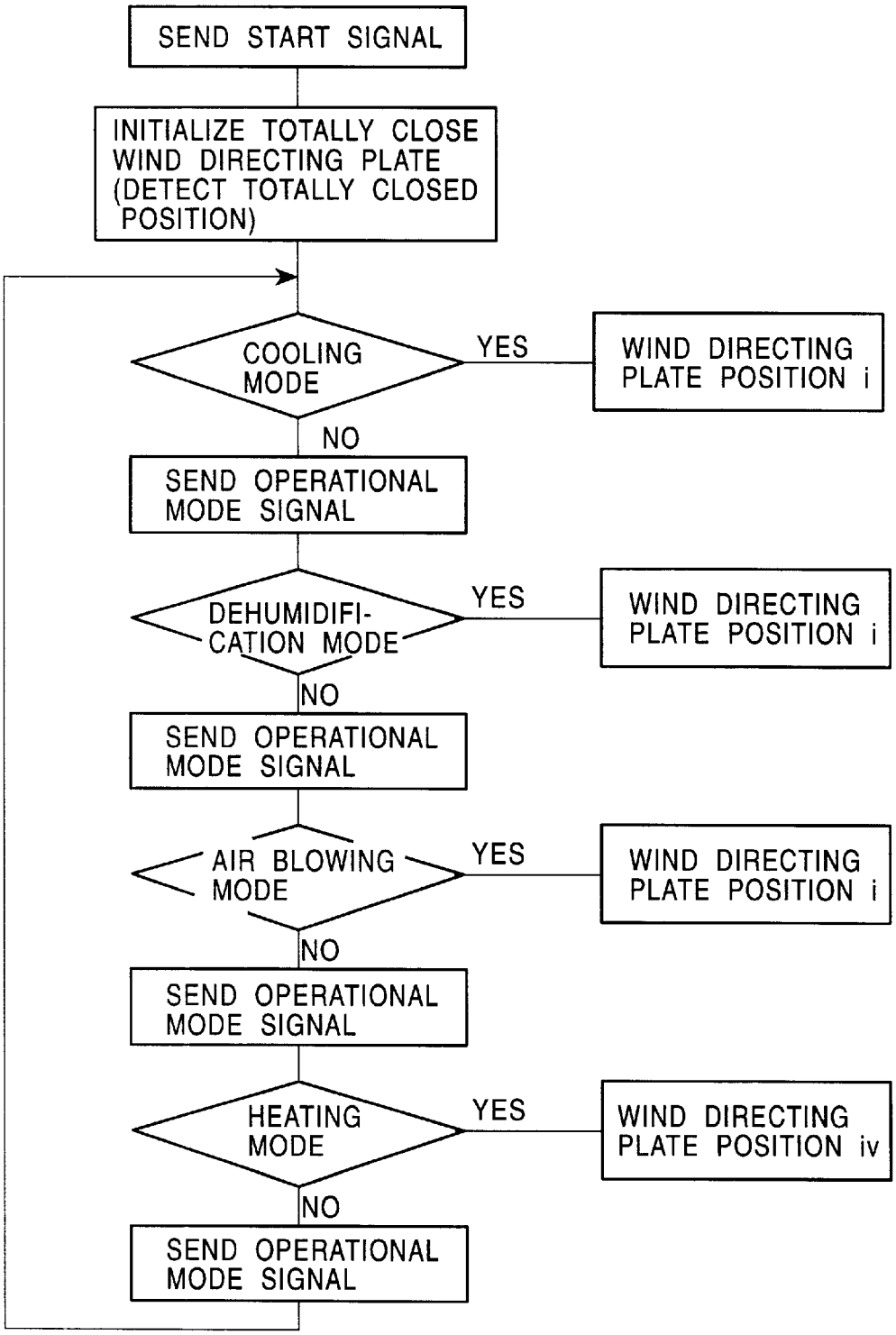
FIG. 22 is a flow chart for explaining the operation of the wind directing plates.

As shown in a flow chart in FIG. 22, first, a wind directing angle control means (not illustrated) is initialized on receiving an operation starting signal from a remote control unit (not illustrated), and the totally closed position of the wind directing plate is detected. Next, when the operational mode is a cooling mode, dehumidification mode, or an air blowing mode, set angle (1) is selected. On the other hand, when the operational mode is a heating mode, set angle (4) is selected. It should be mentioned that the embodiment is equipped with an automatic reset (memory start) function, and when the function is selected, the operation is started again in the same mode as the previous operational mode.

When a swing mode is selected in a remote control unit, the wind directing plate is vertically moved reciprocatingly at a predetermined angle. Specifically, when the swing mode is selected with the set angle (1), the wind directing plate swings at angles ranging from the set angle (1) to the set angle (3). When the swing mode is selected with the set angle (2) or (3), the wind directing plate swings at angles ranging from the set angle (2) to the set angle (4). When the swing mode is selected with the set angle (4), the wind directing plate swings at angles ranging from the set angle (1) to the set angle (4).

Figure 23:
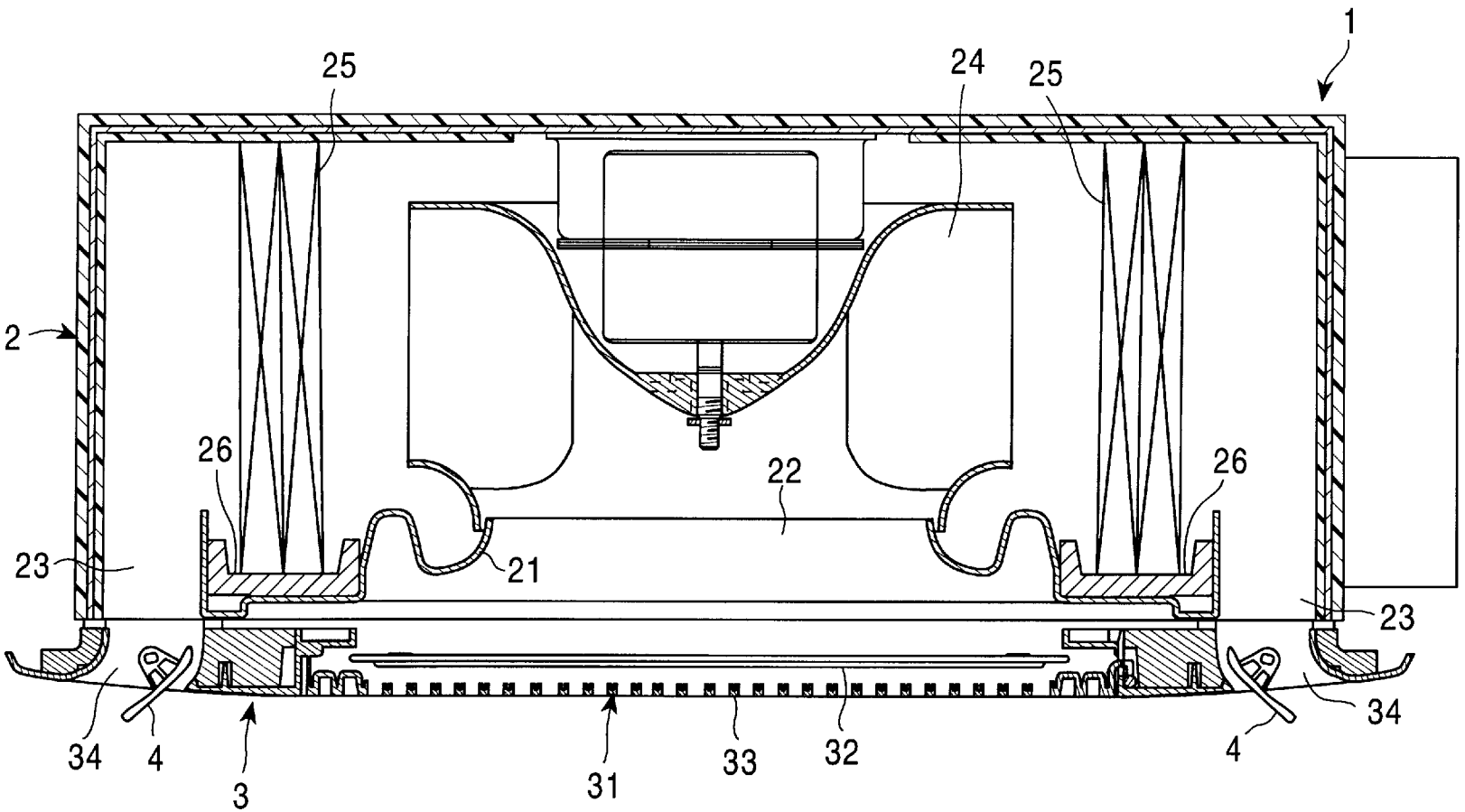
FIG. 23 is a general sectional view of an air conditioner mounted in a ceiling as the conventional art.
Figure 24:
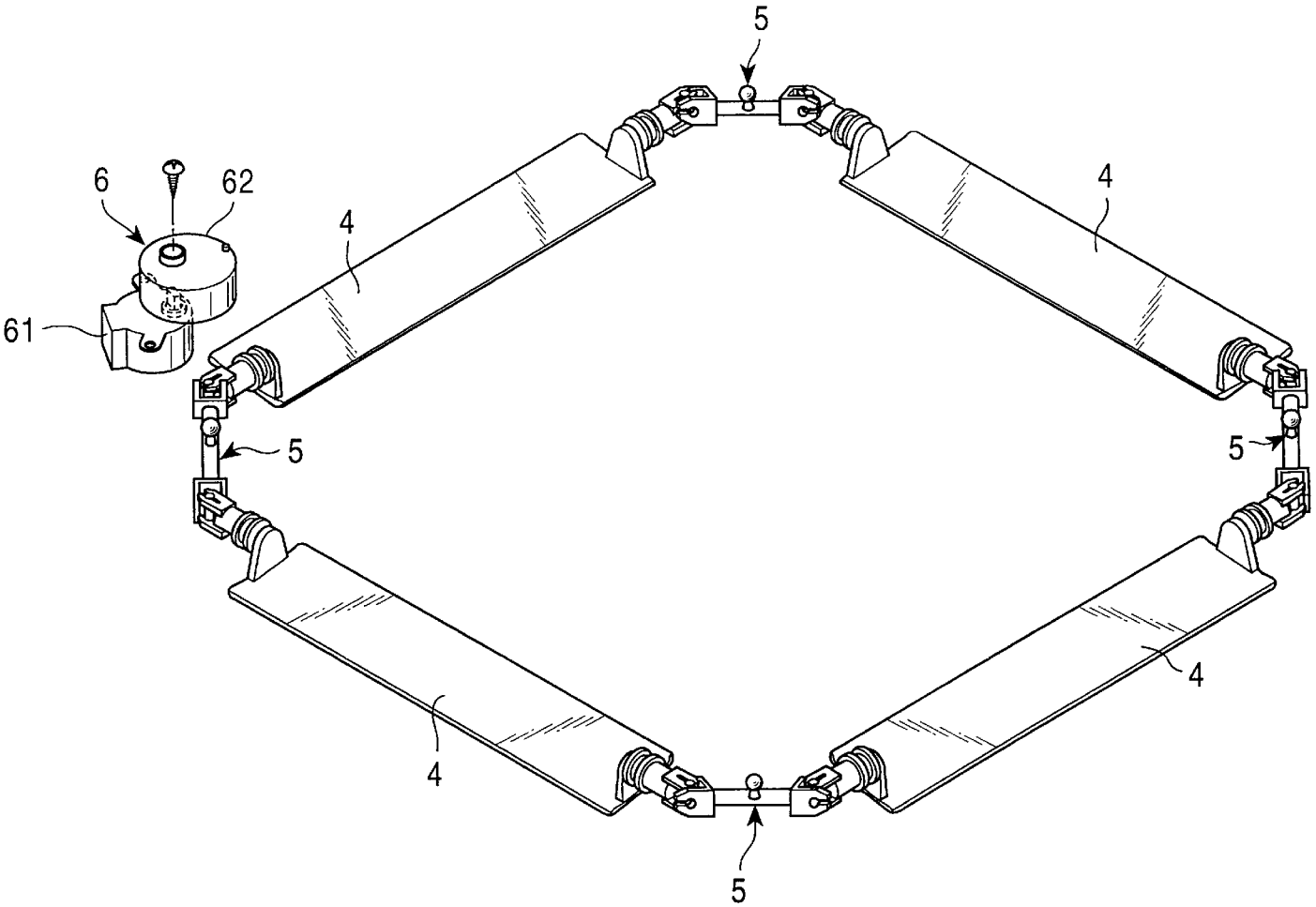
FIG. 24 Prior Art
FIG. 24 is a perspective view showing four of the wind directing plats incorporated in the aforementioned conventional art.

On starting the operation, in the present invention, a turbo fan 24 (see FIG. 23) serving as an air fan is controlled to be actuated after the wind directing plate 4 is held at any one of set angles (1) to (4) from the totally closed position C by the wind directing plate driving means 10. Thereby preventing an increase in load on the wind directing plate driving means 10 caused by air blow at the totally closed position C of the wind directing plate 4.

In the above, the present invention is particularly explained in a concrete form, and it will be easy for those who are skilled in the art and understand the aforementioned description to think of the modifications, the improvements, and the equivalent means. Accordingly, the attached claims and the equivalents thereto should be included in the scope of the present invention.

What is claimed is:

1. An air conditioner which includes an almost rectangular main body housing provided with a first opening for taking in air at a middle portion of a bottom face and with a second opening for blowing air formed around said first opening, and placed to be embedded in an indoor ceiling, and a front panel attached on the bottom face of said main body housing to be attachable and detachable, said main body housing being provided inside with an air fan for taking in indoor air from said first opening and blowing the air towards said second opening, and an heat exchanger disposed around said air fan, and said front panel being provided with an air inlet communicated with said first opening, four of air outlets disposed along respective sides of said main body housing to be communicated with said second opening, a wind directing plate vertically rotatable around a horizontal axis of rotation in each of said air outlets, coupling means for coupling each of said wind directing plates to be synchronously rotatable, and wind directing plate driving means for driving said wind directing plates, only one of said wind directing plate driving means being formed to drive each of said wind directing plates: wherein said wind directing plate driving means includes a motor having an output gear, and a cam gear having a gear portion meshed with said output gear on the periphery thereof with a helical cam slot being formed on one of faces, and a lever which is provided at said coupling means, and which converts rotational motion of said cam slot into linear motion and transmits the motion to said coupling means, and a motor cover mounted on a predetermined corner portion of said front panel, with said motor and said cam gear being assembled and attached on an inside surface, which faces said front panel, of said motor cover.

2. The air conditioner according to claim 1, wherein said motor cover is provided with a motor mounting pedestal having a shaft insertion hole, and a cam gear housing recess having a cut-out portion at a part thereof facing said motor mounting pedestal with a rotational shaft of said cam gear being vertically provided at a center thereof, with said motor being mounted on an inside surface of said motor mounting pedestal with an output shaft thereof being inserted through said shaft insertion hole, and with said output gear being mounted onto the output shaft of said motor on an outside surface of said motor mounting pedestal and being meshed with said cam gear, which is in said cam gear housing recess, in said cut-out portion.

3. The air conditioner according to claim 2, wherein said shaft insertion hole is an oblong along a radial direction of said cam gear housing recess.

4. The air conditioner according to claim 2, wherein said motor includes mounting flanges on both sides thereof, and a hook for engaging with one of the mounting flanges, and a screw bearing boss for fastening the other of the mounting flanges with a screw are provided on the inside surface of said motor mounting pedestal.

5. The air conditioner according to claim 2, wherein an inverted L-shaped fall-off prevention hook for preventing said output gear, which is meshed with said cam gear, from being dismounted from said output shaft is provided on the outside surface of said motor mounting pedestal.

6. The air conditioner according to claim 2, wherein said cam gear comprises a sector gear having a portion without teeth, and only the radial length of the portion without teeth is formed to be shorter than the length from said rotational shaft to said motor mounting pedestal facing a cut-out portion.

7. The air conditioner according to claim 1, wherein said cam gear is provided with a see-through hole through which an inside of the aforementioned cam slot is seen from the another side face thereof.

8. The air conditioner according to claim 2, wherein stopper means for regulating a place where said cam gear rotates is provided between said cam gear and a cam gear housing recess.

9. The air conditioner according to claim 1, wherein an engaging hook for engagingly retaining a suspending wire extending from a main body housing side is provided at a side including the corner portion, on which said motor cover is mounted, of said front panel.

10. The air conditioner according to claim 1, wherein said coupling means for coupling each of said wind directing plates is a hook type of universal joint.

11. The air conditioner according to claim 1, wherein said coupling means for coupling each of said wind directing plates is a flexible universal joint.

12. The air conditioner according to claim 10, wherein a rib plate having a U-shaped shaft bearing slot for holding a rotational shaft of said wind directing plate is formed at said front panel, and wherein a sleeve bush for engaging in said shaft bearing slot is integrally formed at a joint member of said universal joint attached to said rotational shaft.

13. The air conditioner according to claim 12, wherein a holding portion for engaging in said shaft bearing slot and holding said sleeve bush is integrally formed at said motor cover.

14. The air conditioner according to claim 1, wherein with the corner portion, on which said wind directing plate driving means is disposed, of said front panel being referred to as a first corner portion, at a fourth corner portion located on a diagonal line seen from the first corner portion, provided is first spring means for giving momentum in a direction to close two of said wind directing plates adjacent to the fourth corner portion.

15. The air conditioner according to claim 1, wherein with the corner portion, on which said wind directing plate driving means is disposed, of said front panel being referred to as a first corner portion, at a second and a third corner portions which are opposing corner portions at respective sides adjacent to the first corner portion, respectively provided are second spring means for giving momentum to said wind directing plates in a predetermined direction.

16. The air conditioner according to claim 1, wherein with the corner portion, on which said wind directing plate driving means is disposed, of said front panel being referred to as a first corner portion, at a fourth corner portion located on a diagonal line seen from the first corner portion side, provided is first spring means for giving momentum in a direction to close two of said wind directing plates adjacent to the fourth corner portion, and at a second and a third corner portions which are opposing corner portions at respective sides adjacent to the first corner portion, respectively provided are second spring means for giving momentum to each of said wind directing plates in a predetermined direction.

17. The air conditioner according to claim 14, wherein said first spring means includes two of springs respectively attached at rotational shafts disposed at foremost ends of two of said wind directing plates adjacent to said fourth corner portion.

18. The air conditioner according to claim 14, wherein rotational shafts disposed at foremost ends of two of said wind directing plates adjacent to said fourth corner portion are coupled to each other with a universal joint, and wherein said first spring means comprises only one spring acting on the universal joint.

19. The air conditioner according to claim 15, wherein each of said second spring means disposed on said second and third corner portions comprises only one spring acting on a universal joint as a coupling means for coupling said wind directing plates in each of the corner portions.

20. The air conditioner according to claim 1, wherein on starting operation, said air fan is controlled to be actuated after said wind directing plates are held at a predetermined open angular positions from totally closed positions thereof by said wind directing plate driving means.

* * * * *